US012061071B2

(12) United States Patent
Lovell, III et al.

(10) Patent No.: US 12,061,071 B2
(45) Date of Patent: Aug. 13, 2024

(54) PORTABLE TARGET STAND SYSTEM

(71) Applicant: JL CREATIVE GROUP, LLC, Marietta, GA (US)

(72) Inventors: John B. Lovell, III, Woodstock, GA (US); William E. Temple, Marietta, GA (US); Joseph L. Allison, Yuma, AZ (US)

(73) Assignee: JL CREATIVE GROUP, LLC, Marietta, GA (US)

( * ) Notice: Subject to any disclaimer, the term of this patent is extended or adjusted under 35 U.S.C. 154(b) by 302 days.

(21) Appl. No.: 16/220,004

(22) Filed: Dec. 14, 2018

(65) Prior Publication Data

US 2020/0191533 A1 Jun. 18, 2020

(51) Int. Cl.
*F41J 1/10* (2006.01)

(52) U.S. Cl.
CPC ..... *F41J 1/10* (2013.01)

(58) Field of Classification Search
CPC .. F41J 1/10; F41J 1/01; F41J 1/00; F41J 5/18
See application file for complete search history.

(56) References Cited

U.S. PATENT DOCUMENTS 1,182,055 A * 5/1916 Thom ..... A63H 3/16 446/100
2,139,822 A * 12/1938 Harris ..... A63H 3/08 446/387
2,345,913 A * 4/1944 Bishop ..... G09F 1/14 40/611.06
2,559,096 A * 7/1951 Tomarin ..... A47G 25/20 223/87
2,880,534 A 4/1959 Lund
3,091,892 A * 6/1963 Bailey ..... A63H 7/00 446/366
3,273,517 A * 9/1966 Amthor, Jr. ..... A47B 27/14 108/2
3,515,388 A 6/1970 Zachmeier
3,914,879 A * 10/1975 Taylor, III ..... F41J 7/06 434/19
3,930,331 A * 1/1976 Simeone ..... A63H 3/02 446/369
4,052,058 A * 10/1977 Hintz ..... A63F 9/0204 273/446
4,071,113 A * 1/1978 Pelser ..... B25H 1/06 182/151
4,188,067 A * 2/1980 Elmer ..... A47C 4/021 297/440.13

(Continued)

*Primary Examiner* — Melba Bumgarner
*Assistant Examiner* — Amir A Klayman
(74) *Attorney, Agent, or Firm* — Renner Kenner, et al.; Andrew B. Morton

(57) ABSTRACT

A portable target stand system includes a pair of legs, wherein each leg has a body with a front edge and a receiver slot positionally alignable with each other. The system also includes a member having a plate that has a pair of leg slots that slidably receives one of the leg bodies. Each receiver slot slidably receives the member and a cross lap joint is formed between each leg slot and a corresponding one of the receiver slots provided by each leg. The member may consist of a torso target member, a swinger target member, a paper adapter member, or a dummy adapter member.

16 Claims, 20 Drawing Sheets

(56) References Cited

U.S. PATENT DOCUMENTS 4,196,674 A * 4/1980 Van Laarhoven ..... A47B 27/02 108/4
4,433,753 A * 2/1984 Watson ..... B25H 1/06 182/151
4,454,678 A * 6/1984 Duvivier ..... A63H 33/105 446/112
4,520,584 A 6/1985 Howard ..... 40/606
4,574,917 A * 3/1986 Stoddard ..... B25H 1/06 108/56.1
4,640,386 A * 2/1987 Hall ..... B25H 1/06 182/155
4,700,986 A * 10/1987 Davis ..... A47B 3/14 108/64
4,889,512 A * 12/1989 Burnett ..... A63H 3/005 446/72
4,890,693 A * 1/1990 O'Brien ..... B25H 1/06 182/151
4,916,840 A * 4/1990 Getz ..... G09F 7/00 40/605
4,923,051 A * 5/1990 Newville ..... B25H 1/06 182/151
4,942,683 A * 7/1990 Lawson ..... B43L 3/00 223/69
5,031,683 A * 7/1991 Marvy ..... E01F 9/688 160/351
5,125,478 A * 6/1992 Henningsen ..... B25H 1/06 182/155
D329,665 S 9/1992 Carroll ..... D21/5
5,181,719 A * 1/1993 Cleveland, III ..... F41J 1/00 273/409
5,222,741 A * 6/1993 Redl ..... F41J 7/04 273/393
5,240,258 A * 8/1993 Bateman ..... F41J 7/04 273/392
5,257,790 A * 11/1993 Meadows ..... F41J 7/04 273/389
D343,585 S 1/1994 Strong ..... D10/109
5,277,432 A * 1/1994 Bateman ..... F41J 1/10 273/407
5,305,850 A * 4/1994 McQuiston ..... B25H 1/06 182/151
5,605,378 A * 2/1997 Oyediran ..... A47C 4/021 297/440.13
5,644,995 A * 7/1997 Gurwell ..... A47B 3/12 108/158.12
5,924,694 A * 7/1999 Kent ..... F41J 1/01 273/408
5,975,317 A * 11/1999 Roebling ..... A47F 5/108 211/196
5,992,938 A * 11/1999 Jones ..... A47C 4/021 297/440.13
6,061,972 A * 5/2000 Thorp ..... A47F 5/105 160/351
D453,038 S 1/2002 Scott ..... D22/113
6,378,707 B1 * 4/2002 Taggert ..... A47B 65/00 211/186
6,419,542 B1 * 7/2002 Liu ..... A63H 3/10 446/387
6,601,326 B1 * 8/2003 Bublitz ..... G09F 19/08 40/418
6,626,732 B1 * 9/2003 Chung ..... A63H 3/52 446/268
7,111,708 B2 * 9/2006 Frey ..... B25H 1/04 182/151
7,128,321 B1 10/2006 Brown ..... 273/392
7,168,766 B2 * 1/2007 Pelletier ..... A47C 3/029 297/440.13
7,325,808 B1 2/2008 Adler et al. ..... 273/407
7,549,248 B1 * 6/2009 Luster ..... A01M 31/06 40/412
D650,444 S * 12/2011 Farver ..... D20/31
8,117,780 B2 2/2012 Matthews et al. ..... 42/114
8,167,377 B2 * 5/2012 Kovach ..... A47C 4/03 297/440.13
8,176,665 B2 5/2012 Petrovic ..... 40/607.1
8,413,991 B2 * 4/2013 Sudbeck ..... F41J 7/04 273/392
8,490,978 B2 * 7/2013 Rogers ..... F41J 7/04 273/392
8,622,394 B2 1/2014 Larue ..... 273/407
8,656,628 B2 2/2014 Jock et al. ..... 42/113
D712,003 S 8/2014 Bailey ..... D22/113
9,010,012 B2 4/2015 Matthews et al. ..... F41G 1/30
9,227,145 B2 * 1/2016 Chang ..... A63H 3/10
9,513,091 B2 * 12/2016 Roberts ..... F41J 1/01
D775,692 S 1/2017 Tedeschi ..... D21/303
9,574,855 B2 * 2/2017 Davis ..... F41J 5/205
9,631,904 B2 4/2017 Cesternino ..... F41J 1/10
D787,008 S 5/2017 Hale ..... D22/113
D788,876 S 6/2017 Brooks ..... D22/113
9,714,816 B2 7/2017 Temple ..... F41J 1/10
9,746,291 B1 8/2017 Crawford ..... F41J 5/18
9,784,538 B2 10/2017 Sovine et al. ..... F41J 1/10
9,797,694 B1 * 10/2017 Cummins ..... F41J 1/10
10,001,350 B2 * 6/2018 Pearcey ..... F41J 1/10
10,155,308 B2 * 12/2018 Wysong ..... B25H 1/06
10,168,129 B2 1/2019 Brune ..... F41J 7/04
D849,872 S 5/2019 Lessnick ..... D22/113
D854,645 S 7/2019 Coppi ..... D22/113
D856,462 S 8/2019 Wilson ..... D22/113
D860,376 S 9/2019 Boso ..... D22/113
10,502,535 B2 * 12/2019 Sun ..... F41J 7/04
D932,347 S * 10/2021 Goh ..... D11/160
2003/0046840 A1 * 3/2003 Evans ..... G09F 1/08 40/538
2003/0077109 A1 * 4/2003 Chen ..... F16C 11/0619 403/52
2005/0001981 A1 * 1/2005 Anderson ..... A61B 3/113 351/209
2007/0045965 A1 * 3/2007 Bateman ..... F41J 1/10 273/407
2009/0295094 A1 * 12/2009 Duerr ..... F41J 1/10 273/348
2011/0062668 A1 * 3/2011 Leimberer ..... F41J 5/205 273/407
2012/0274028 A1 * 11/2012 Sudbeck ..... F41J 7/04 273/386
2013/0207347 A1 * 8/2013 Sovine ..... F41J 7/04 273/390
2015/0276356 A1 * 10/2015 Cesternino ..... F41J 1/10 273/370
2015/0330747 A1 * 11/2015 Ferrell ..... F41J 1/10 273/407
2016/0202026 A1 7/2016 Temple ..... F41J 1/10
2016/0209184 A1 7/2016 Anderson et al. ..... F41J 7/04
2017/0045338 A1 * 2/2017 McGovern ..... F41J 1/01
2017/0321997 A1 * 11/2017 Farda ..... F41J 1/10
2017/0336180 A1 * 11/2017 Sun ..... F41J 7/04
2018/0035799 A1 * 2/2018 Leafgren ..... A47B 23/00
2018/0087881 A1 * 3/2018 Bickel ..... F41J 1/10
2018/0216921 A1 * 8/2018 Daub ..... F41J 1/10
2019/0011229 A1 * 1/2019 Babcock ..... F41J 1/10
2019/0186874 A1 * 6/2019 Taub ..... F41J 5/04
2020/0025532 A1 * 1/2020 Williams ..... F41J 1/10
2021/0033373 A1 * 2/2021 Babcock ..... F41J 7/04

* cited by examiner

PORTABLE TARGET STAND SYSTEM

TECHNICAL FIELD

Generally, the present invention is directed to portable firearm targets. Specifically, the present invention is directed to portable firearm target stands which are easily assembled and disassembled.

BACKGROUND ART

For individuals who use firearms in their profession or as a hobby, it is advantageous to train in outdoor settings. Such settings provide additional environmental factors that are typically not present in indoor settings, such as weather, miscellaneous noises, and different terrains. To this end, it is known to use portable targets that can be assembled in the outdoor setting.

Most targets are constructed of paper or other biodegradable material and maintained on controlled firing line ranges. However, some firearm training and practice is undertaken in remote areas. In such instances, steel targets may be employed. Skilled artisans will appreciate that steel or other hardened material targets are needed to absorb repeated bullet impacts and can provide an audible confirmation when the target is hit. However, such steel targets are cumbersome to carry to a remote site, are heavy, and often times difficult to set up.

In view of these difficulties, an individual is less likely to practice and train in an outdoor setting. Therefore, there is a need in the art for a target which is portable, durable, and versatile. In other words, there is a need for a portable target stand system which is easy to transport, easy to set up, can be modified for different types of targets, and is easy to disassemble and transport to an appropriate storage facility.

SUMMARY OF THE INVENTION

In light of the foregoing, it is a first aspect of the present invention to provide a portable target stand system.

It is another aspect of the present invention to provide a portable target stand system comprising a pair of legs, each leg having a body with a front edge, each front edge having a receiver slot, wherein the receiver slots are positionally alignable with each other, and a member having a plate, the plate having a pair of leg slots, each leg slot slidably receiving one of the leg bodies, and each receiver slot slidably receiving the member.

BRIEF DESCRIPTION OF THE DRAWINGS

These and other features and advantages of the present invention will become better understood with regard to the following description, appended claims, and accompanying drawings wherein:

FIGS. 5A and 5B are perspective views of a portable target stand utilizing a swinger target member according to the concepts of the present invention wherein FIG. 5A shows a pair of swinger target discs positioned within the swinger target member and FIG. 5B shows one of the swinger target discs extended away from the swinger target member;

BEST MODE FOR CARRYING OUT THE INVENTION

Figure 1:
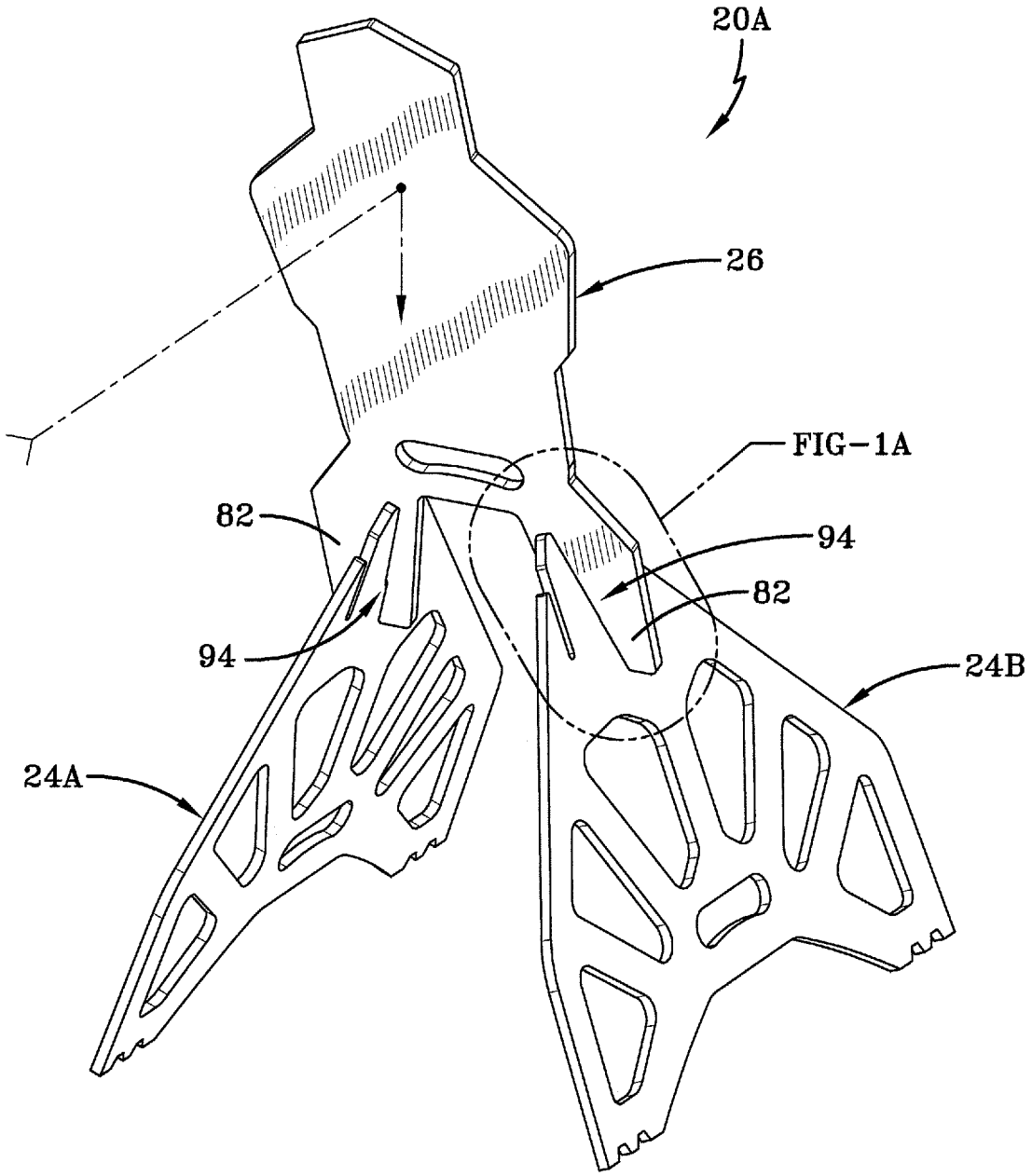
FIG. 1 is a perspective view of a portable target stand utilizing a torso target member according to the concepts of the present invention.

As seen in the drawings and as will be understood from the following discussion, a portable target stand system is presented which provides for a pair of legs and various target and/or adapter members that are easily assembled and disassembled for transport to and from outdoor settings. The legs and members are constructed of plate-like components which can be carried by hand or in an all-terrain vehicle. Aligned hand holds in the legs and members facilitate carrying the components from one place to another. The assembly of the components is simple, yet robust, wherein mechanical fasteners and tools are not required.

Referring now to FIGS. 1-4, it can be seen that a portable target stand is designated generally by the numeral 20A. As will become apparent as the detailed description proceeds, the various portable target stands to be presented may be easily assembled and disassembled to allow for positioning of the target stands in an outdoor environment, and in most any terrain where at least a minimal flat area can be provided. In all of the embodiments described herein, major components of the target stand may be constructed of a steel material, such as AR550 or other comparable steel or metallic materials may be used. Non-metallic materials may be used if they are effective in deflecting bullets. The thickness of the steel may range from ¼ inch to ¾ inch, but other thicknesses ranging from ⅛ inch to 1¼ inch may be used. The component parts of the target stand embodiments are also easily carried to facilitate their transport to and from the target placement area.

The portable target stand 20A may provide a pair of legs 24 wherein leg 24A is the left leg and leg 24B is the right leg of the target stand as the trainee faces the target. Both legs, together, support or carry a torso target member 26 in the present embodiment. The other embodiments to be described will be provided with corresponding alphabetic suffixes 20B, 20C, and 20D; however, the legs, which are the same for all of the embodiments, are consistently identified as 24A or 24B.

Figure 3A:
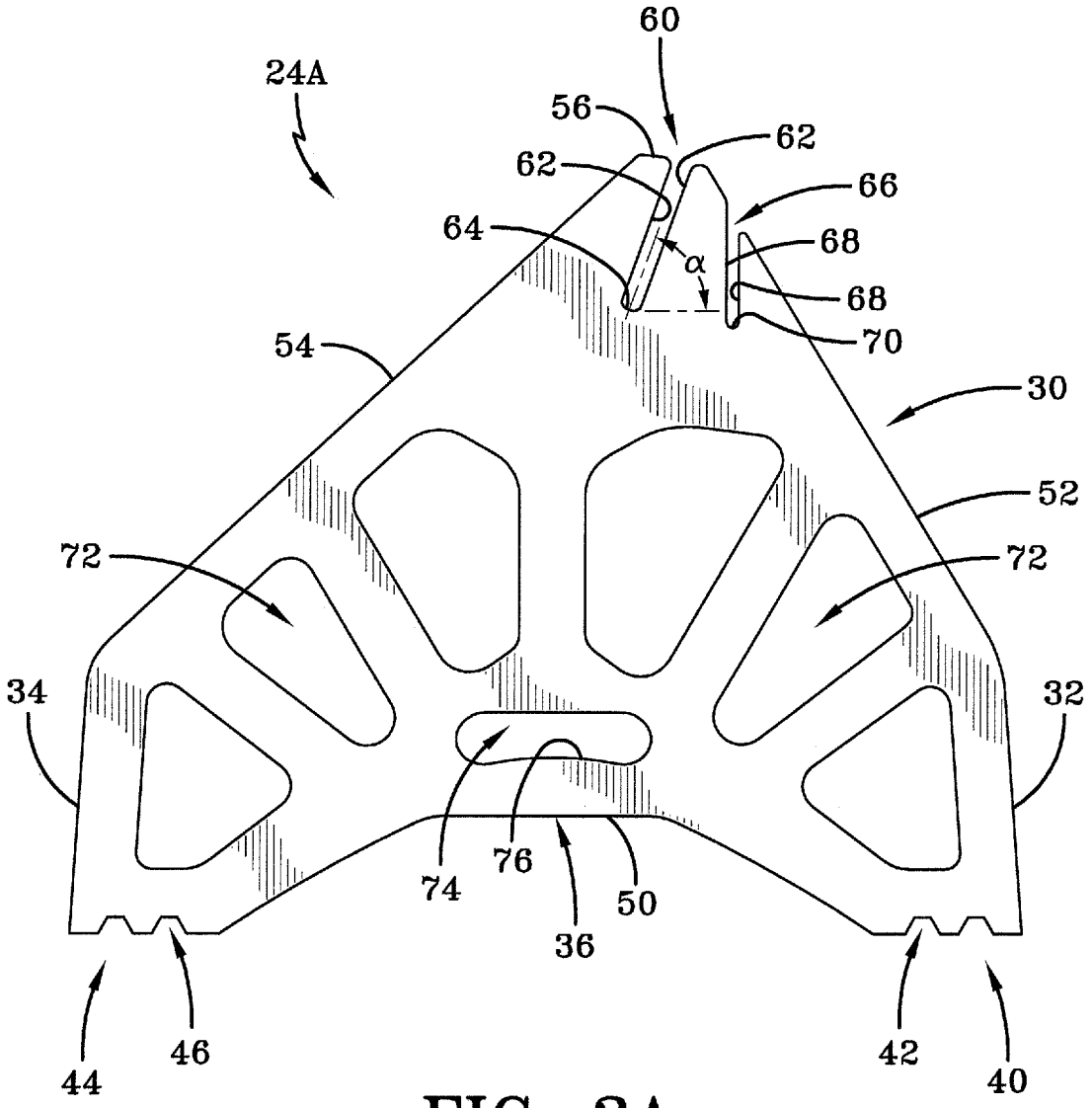
FIGS. 3A and 3B are elevational views of legs used with the portable target stand according to the concepts of the present invention.
Figure 3B:
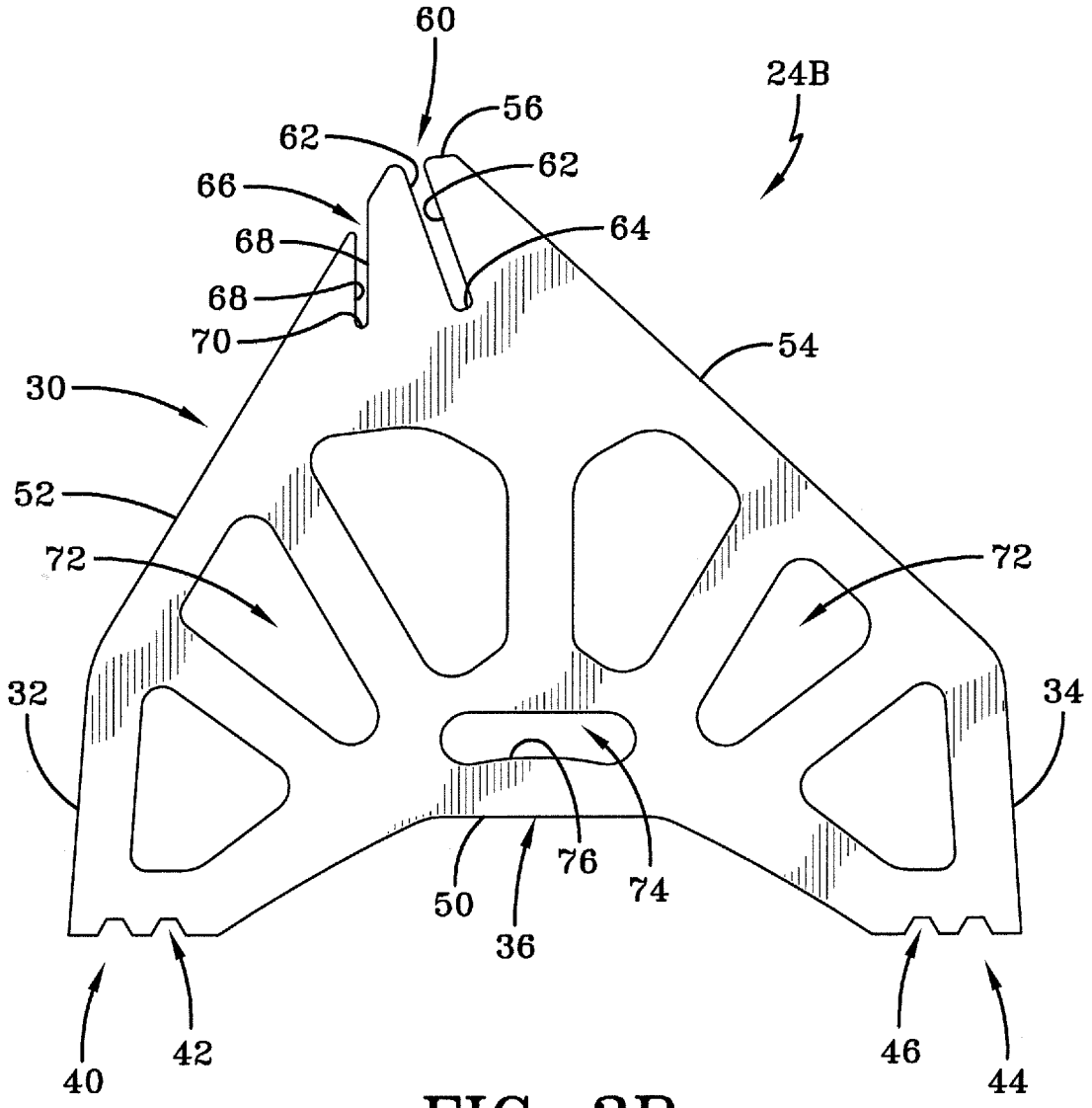

Each leg 24, as seen in FIGS. 3A and 3B, includes a body 30 which provides for a front body edge 32 and a back body edge 34. Both body edges 32 and 34 are connected or joined to one another by a bottom 36. The bottom 36 provides for a front foot 40 approximately positioned near the front body edge 32 and wherein the front foot 40 may provide at least one foot notch 42. In a similar manner, the bottom 36 provides a back foot 44 near the back body edge 34 and wherein the back foot 44 may also provide for at least one foot notch 46. Skilled artisans will appreciate that the feet 40 and 44 and their corresponding notches 42 and 46 provide for a gripping surface that allows for the legs to be positioned within the terrain where the portable target stand 20A is to be placed. The bottom 36 may provide an arc 50 which extends between the front foot and the back foot 44. The arc 50 may provide angular and linear sections as shown or may be any other concave shape as appropriate.

Extending from the front body edge 32 is a front taper edge 52, wherein a back taper edge 54 substantially extends from the back body edge 34. The taper edges 52 and 54 are angularly directed toward one another so as to meet at an apex 56, wherein skilled artisans will appreciate that the apex 56 may be rounded or truncated as appropriate.

In the present embodiment, the portable target stand 20A provides for both legs 24A and 24B to be positioned so that the front body edges 32 and front taper edges 52 of both legs are positioned to face the trainee. The front taper edge 52 may be provided with a target receiver slot 60 which is formed by substantially parallel slot sides 62 which are connected to one another by a slot end 64. Both target receiver slots 60 provided in the respective legs 24A and 24B, and in particular in the respective bodies 30, may be angularly oriented with respect to a line which is substantially parallel with a line tangent to the front foot 40 and the back foot 44 to form an angle $\alpha$ that may be between thirty degrees to eighty degrees, and in the present embodiment is shown to be about eighty degrees as shown in FIG. 3A. Other embodiments may provide an angle of between five degrees to eighty five degrees. The angular orientation of the slot 60 provided by leg 24B shown in FIG. 3B is the same, albeit from an opposite side. In other words, both receiver slots 60 are positionally alignable with one another when the respective front edges face the same direction.

The respective front taper edges 52 may also provide for an adapter receiver slot 66 which may be positioned in the embodiments between the target receiver slot 60 and the front body edge 32. However, skilled artisans will appreciate that the adapter receiver slot 66 may be positioned anywhere along the front taper edge 52 or anywhere along the back taper edge 54. In any event, each adapter receiver slot 66 provides for slot sides 68 which are substantially parallel with one another and which are connected at a slot end 70. In the embodiments shown, the angular orientation of the adapter receiver slot 60 is about ninety degrees with respect to the bottom edge which is formed by a line substantially parallel with a line tangent to the front foot 40 and the back foot 44. The receiver slots 66 are also positionally alignable with one another in the same manner as the receiver slots 60. And it will further be appreciated that the legs 24A and 24B may be provided with both the target receiver slots 60 and the adapter receiver slots 66 as shown, or in some embodiments the legs may only be provided with either the target receiver slots 60 or the adapter receiver slots 66.

In some embodiments the body 30 may be provided with any number of body openings 72 so as to reduce the overall weight of the legs. As such, the legs are still structurally sound but have a reduced weight so as to facilitate their transport to a target site.

The body 30 may also provide for a handle opening 74 which is positioned near the bottom edge 36 and somewhat centered between the feet 40 and 44. The handle opening 74 may provide for a curved carrying edge 76 which may be somewhat parallel with a linear portion of the arc 50. It will further be appreciated that the handle opening 74 is positioned so as to provide a substantially balanced carrying point for the legs to facilitate their transport.

Figure 2:
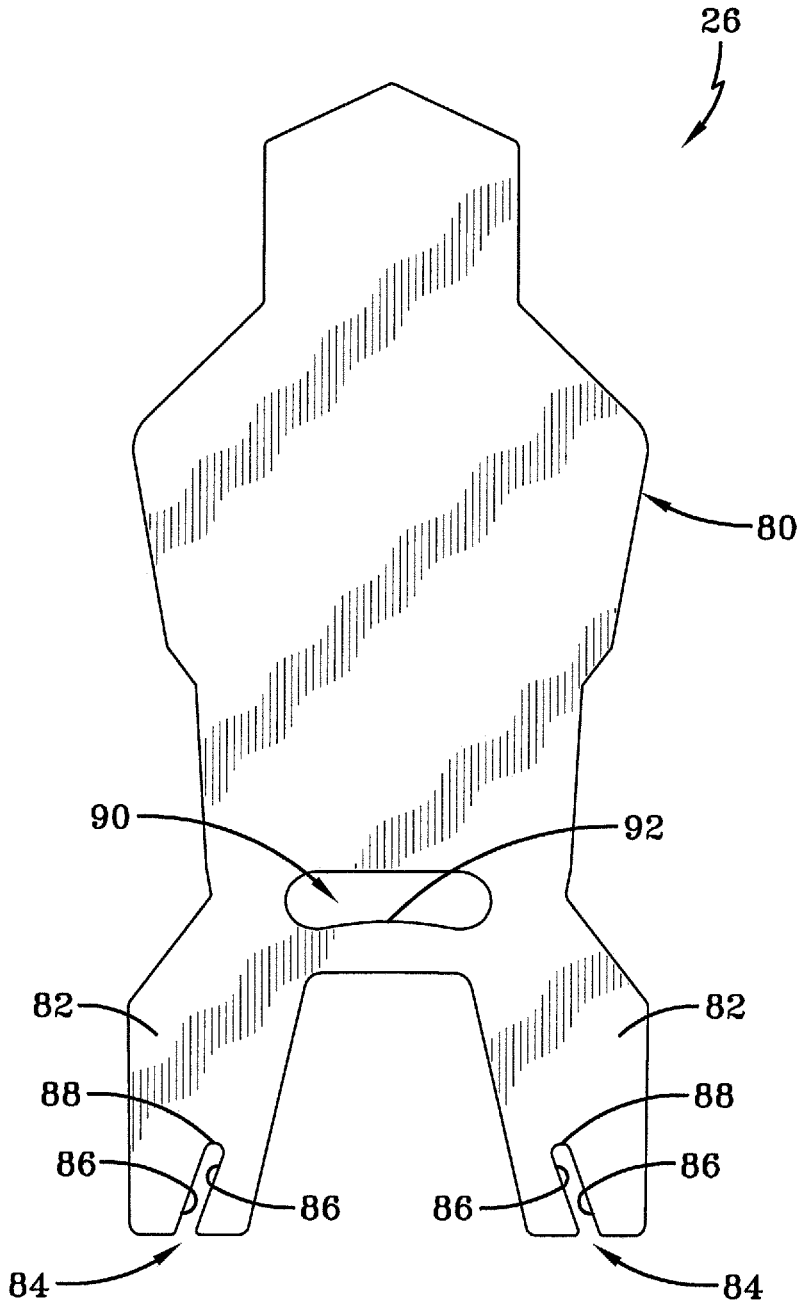
FIG. 2 is a front elevational view of the torso target member used with the portable target stand according to the concepts of the present invention.

Referring now to FIG. 2, it can be seen that the torso target member 26 provides a torso plate 80 which is generally shaped like a person's torso. In other words, the torso plate 80 provides for a head, shoulders, mid-section, and hips that represent a person's body. Skilled artisans will appreciate that the torso plate may be shaped like an animal or other figure as appropriate. Extending from a lower edge of the torso plate 80 are a pair of hips 82. The left hip 82, as shown in FIG. 2, may provide a leg slot 84 which is angularly oriented from between thirty degrees to ninety degrees with respect to a bottom edge of the torso plate 80, wherein the right hip also has a slot 84 that is a mirror image of the slot provided in the left hip. Each leg slot 84 provides for slot sides 86 which are substantially parallel with one another and wherein the slot sides 86 are connected at a slot end 88. Extending through a lower portion of the torso plate in proximity to and in between the hips 82 is a handle opening 90. The handle opening 90 may provide for a substantially curved carrying edge 92 along a surface closest to an edge of the torso plate 80. Skilled artisans will appreciate that the handle opening 90 is substantially centered so as to provide for balance when the member 26 is being carried to a target site.

Figure 1A:
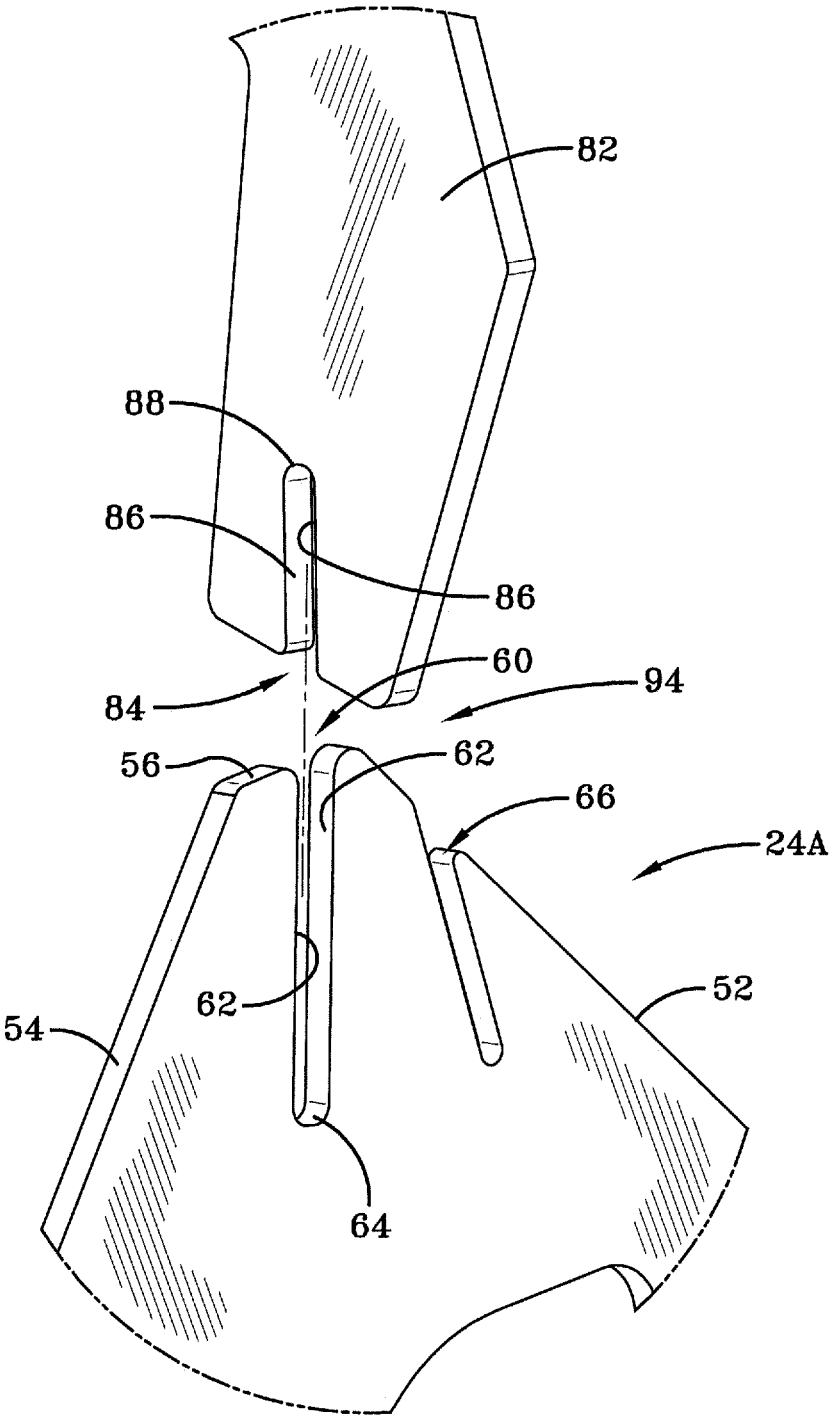
FIG. 1A is a detailed perspective assembly view showing the portable target stand according to the concepts of the present invention.

As best seen in FIG. 1A, the torso target member 26 and the legs 24A and 24B are assembled to one another by inserting the torso plate 80 into a leg 24A. In particular, the leg slot 84 is inserted somewhat perpendicularly onto the leg 24A and in a corresponding manner the target receiver slot 60 is inserted onto the corresponding hip 82. As a result, the slot sides 86 are positioned adjacent or in contact with the leg body 30 and the slot slides 62 are positioned adjacent or in contact with the torso plate 80 in the area of the hips 82. As a result, the target slot end 88 is positioned adjacent to or engages with the leg slot end 64. This coupling of the torso plate 80 with the leg 24A fauns a cross lap joint 94. As a result, the torso plate 80 is prevented from twisting with respect to the leg 24A. Likewise, the leg 24A is prevented from twisting with respect to the torso plate 80. In a similar manner, the leg 24B is coupled to the torso plate 80 so as to form a corresponding cross lap joint 94. Although the torso plate 80 and the legs 24A and 24B may be coupled to one another in other fashions by utilizing other types of joints or by using a mechanical connection, it is believed that the most time saving and efficient configuration is to employ a cross lap joint connection between the torso plate and the legs. As noted, such a configuration prevents twisting of the torso plate 80 with respect to the legs 24A and 24B. Accordingly, bullet impacts are unlikely to cause the torso plate 80 to become disengaged from the legs. The assembled configuration also allows for the assembled portable target stand 20A to withstand environmental factors such as wind and the like.

Figure 4:
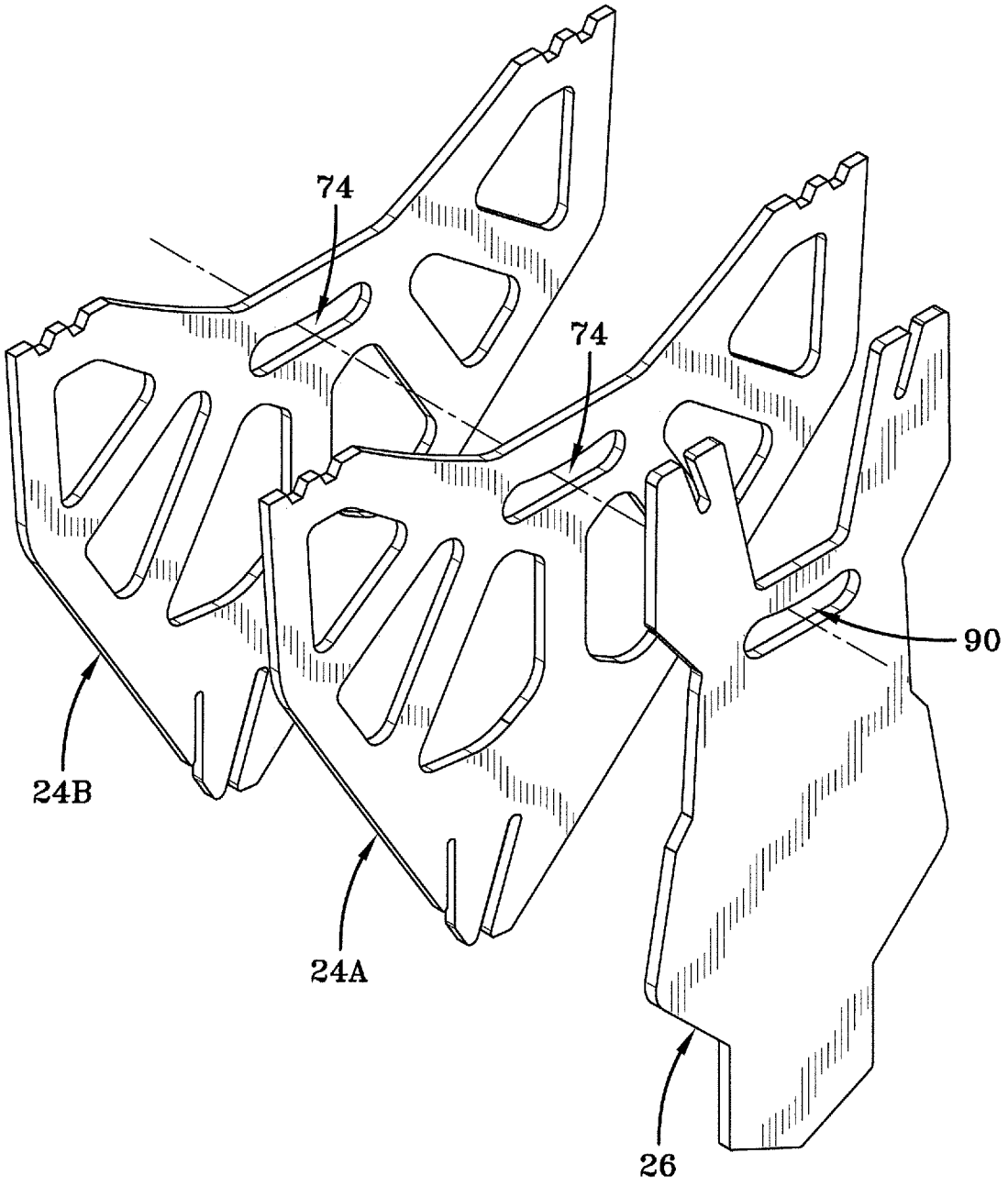
FIG. 4 is a perspective view of the torso target member and the legs aligned with one another with respect to their respective handle openings according to the concepts of the present invention.

Skilled artisans will also appreciate that the handle opening 90 provided by the torso plate 80 and the corresponding handle openings 74 provided by the legs are substantially alignable with one another, as best seen in FIG. 4 and, as such, the three pieces of the portable target stand 20A may be carried by a single individual for assembly at a desired target site.

It will further be appreciated that the torso plate 80 when assembled to the legs is provided with a forward leaning stance such that impacting bullets are directed downwardly and not off in an undesired direction. It will further be appreciated that the leg slots provided by the hips 82 are angularly configured so as to provide a sturdy base for the portable target stand. Indeed, the mating of the non-perpendicular angle of the target receiver slots 60 and the non-perpendicular angle of the leg slots in this and the other embodiments provide a significant mechanical advantage and robustness to assembled target stands when assembled in the field. An advantage may also be obtained when mating the non-perpendicular angle of the leg slots and the substantially perpendicular adapter receiver slots 66.

Referring now to FIGS. 5-9, it can be seen that a portable target stand is designated generally by the numeral 20B. As in the previous embodiment, the target stand 20B provides for a pair of legs 24A and 24B and reference is made to the description above for their structural features. In the present embodiment the target stand 20B employs a swinger target member designated generally by the numeral 100 which is supported and carried by the legs 24A and 24B in a manner similar to the way in which the legs carry the torso target member 26.

The swinger target member 100 includes a swinger plate 102 which provides for a pair of downwardly extending hips 104. Each hip includes an angularly oriented leg slot 106 which is formed by a pair of substantially parallel slot sides 108 that are connected to one another by a slot end 110. In most embodiments the left leg slot 106 is provided at an angle of between thirty degrees to ninety degrees with respect to the swinger plate 102 and the right leg slot is substantially a mirror image of the left leg slot.

Extending through the swinger plate 102 is a bottom handle opening 112 which may be positioned substantially centered between the pair of hips 104. The handle opening 112 may provide for a curved carrying edge 114 near a bottom edge of the swinger plate 102. The swinger plate 102 may also provide for a top handle opening 116 at a top edge opposite the bottom edge of the swinger plate 102. The handle opening 116 may provide for a rounded carrying edge 118 which is somewhat parallel with a top edge of the swinger plate 102. As a result, the swinger plate 102 may be carried from a top orientation or from a bottom orientation.

Associated with the swinger plate 102 is at least one swinger target assembly designated generally by the numeral 120. Although two swinger target assemblies are shown, it will be appreciated that one or more than one target assembly may be associated with the swinger plate 102. Each swinger target assembly 120 provides for a target opening 122 that extends through the swinger plate 102. A swinger 124 may be coupled to the swinger plate 102. Each swinger 124 includes a target disc 126 which is sized to substantially cover the target opening 122. A swing arm 128 is connected to one side of the target disc 126 at one end and at an opposite end the swinger arm 128 provides for a hinge end 130. A hinge mechanism 134 connects the hinge end 130 to a surface of the swinger plate 102.

Figure 6:
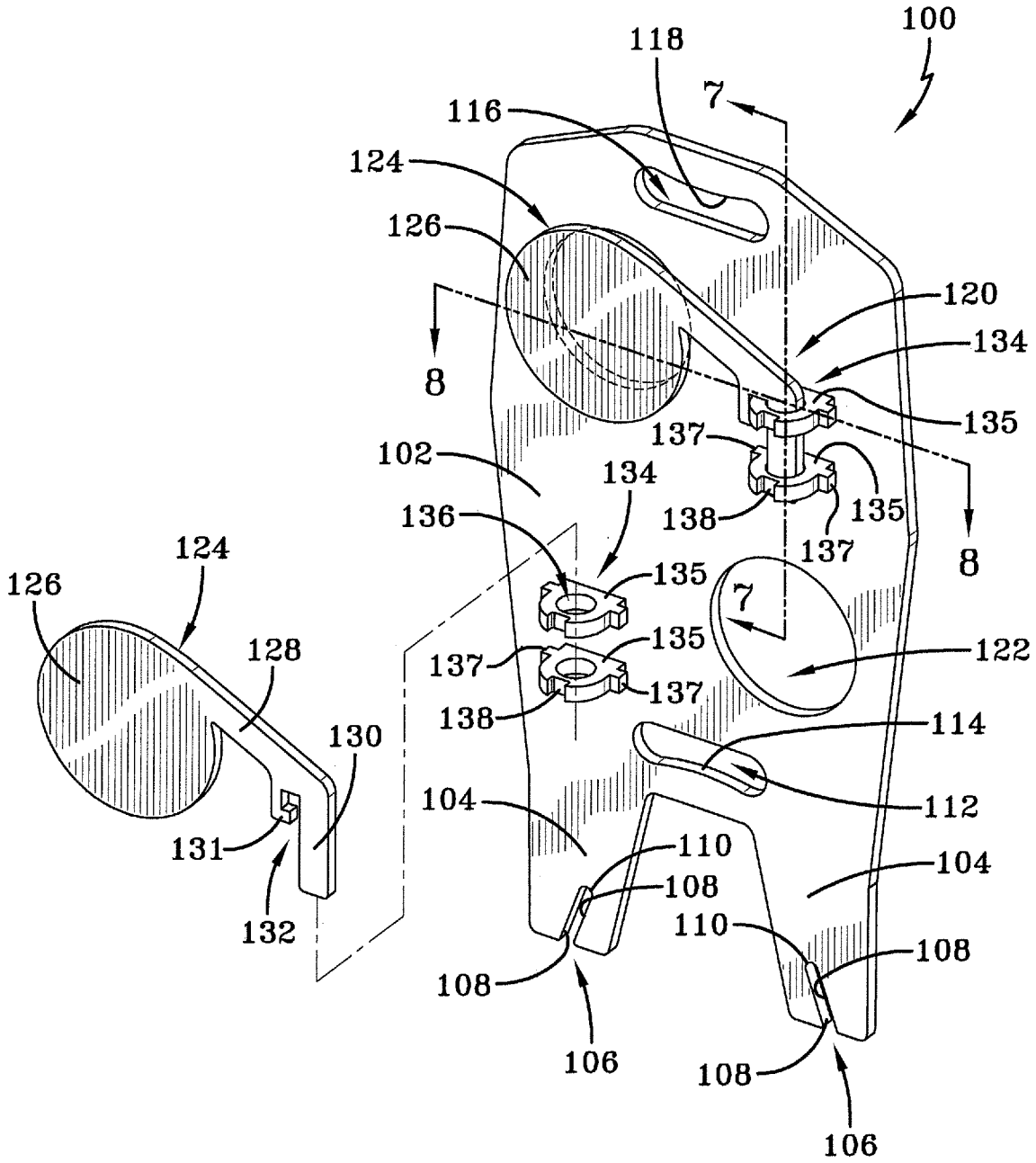
FIG. 6 is a rear perspective and exploded view of the swinger target member according to the concepts of the present invention.
Figure 7:
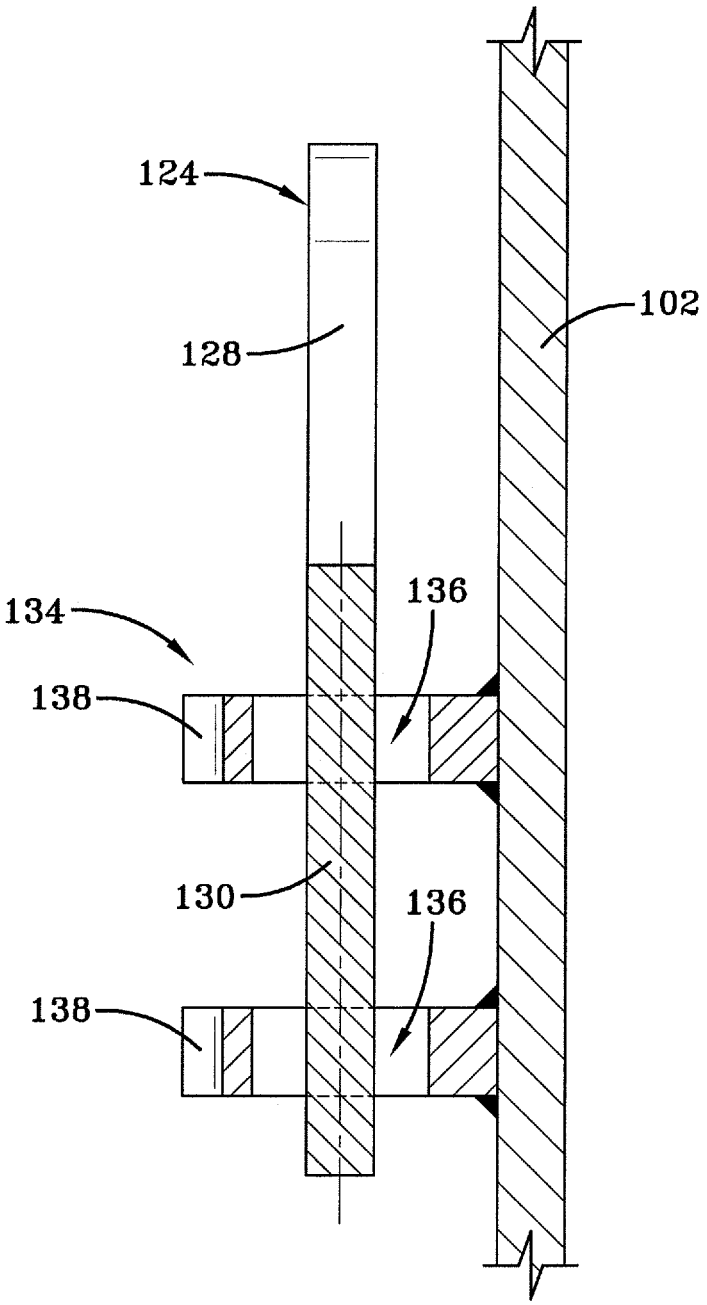
FIG. 7 is a side cross-sectional view of a hinge mechanism connecting a swinger target assembly to the swinger target member taken along lines 7-7 of FIG. 6 according to the concepts of the present invention.
Figure 8:
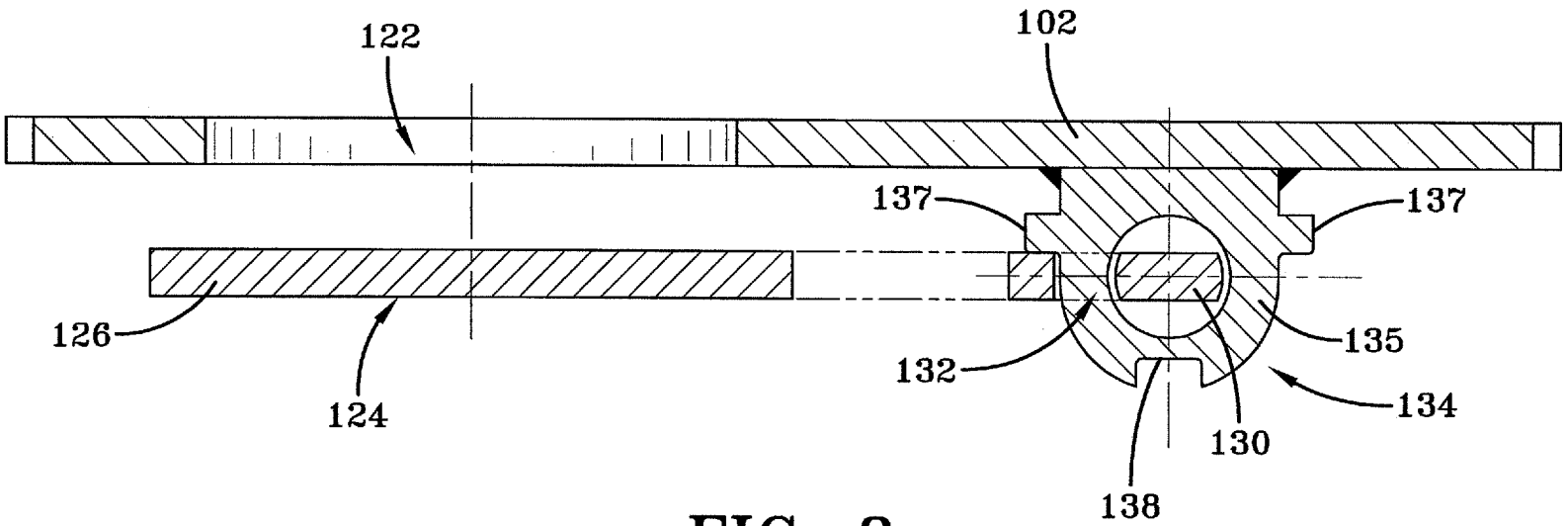
FIG. 8 is a top cross-sectional view of the hinge mechanism taken along lines 8-8 of FIG. 6 according to the concepts of the present invention.

As best seen in FIGS. 6-8, a retaining hook 131 extends in the same direction as the hinge end 130 from the swing arm 128. The retaining hook 131 faces the hinge end 130 and forms a tab gap 132 therebetween. The hinge mechanism 134 comprises a pair of opposed collars 135 that are fixed, such as by welding or other mechanism, from a back surface of the swinger plate 102. The opposed collars 135 each have a collar hole 136 that is aligned with the other. Radially extending from each collar is a pair of tabs 137 which are spaced about one hundred eighty degrees apart and which are substantially parallel with the back surface of the swinger plate 102. About ninety degrees from each of the tabs 137 is a notch 138. As best seen in FIG. 8, the tabs 137 block further rotation and movement of the swinger 124. Accordingly, when the target disc 126 is struck by a bullet, the impact causes the swinger arm 128 to rotate about one hundred eighty degrees until the swing arm 128 and in particular the retaining hook 131 hits the opposing tab 137. As skilled artisans will appreciate, the notch 138 allows for insertion of the swinger 124 onto the hinge mechanism 134. In particular, the notch 138 is sized so as to slidably receive the inwardly extended portion of the retaining hook 131.

Figure 5A:
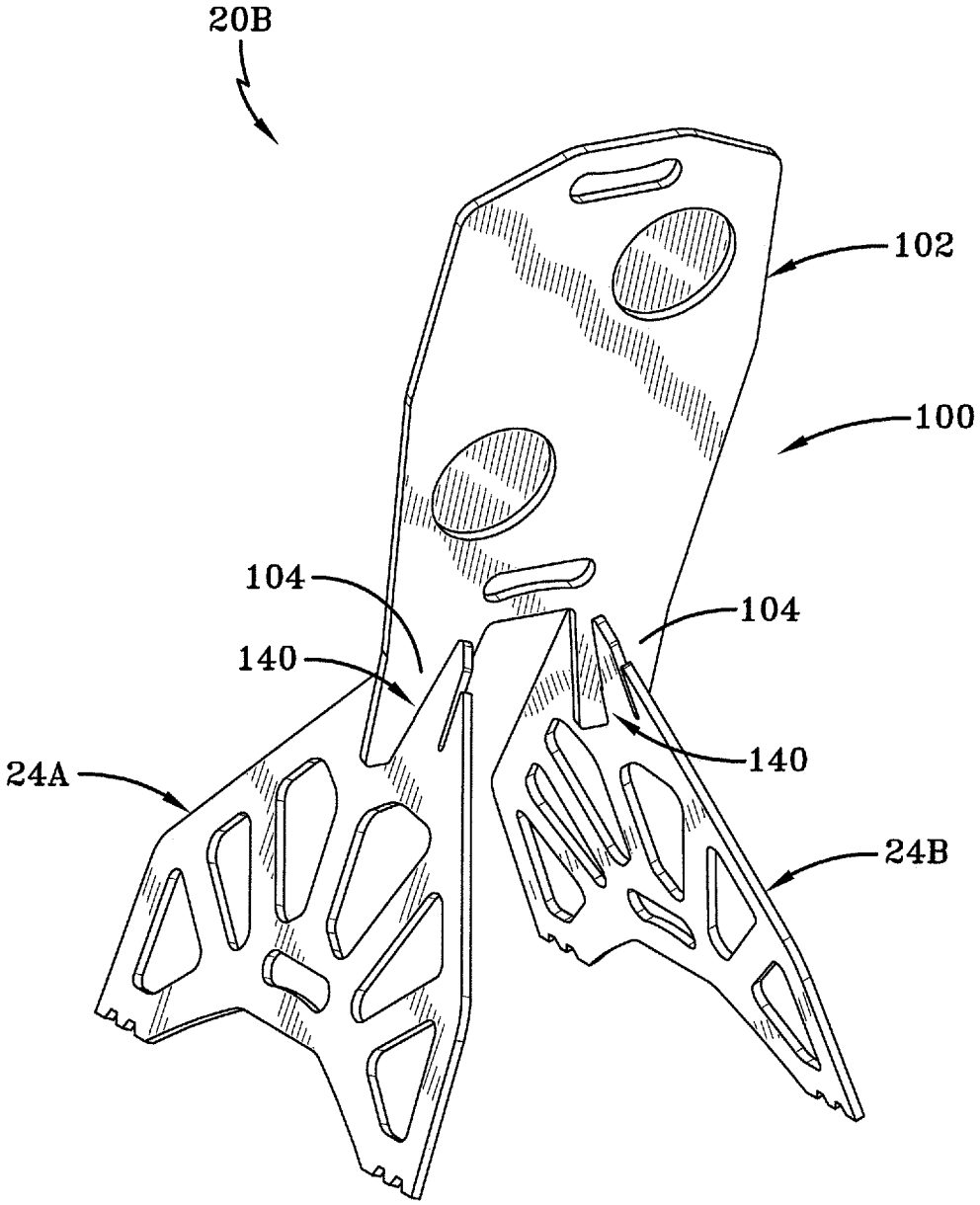
Figure 5B:
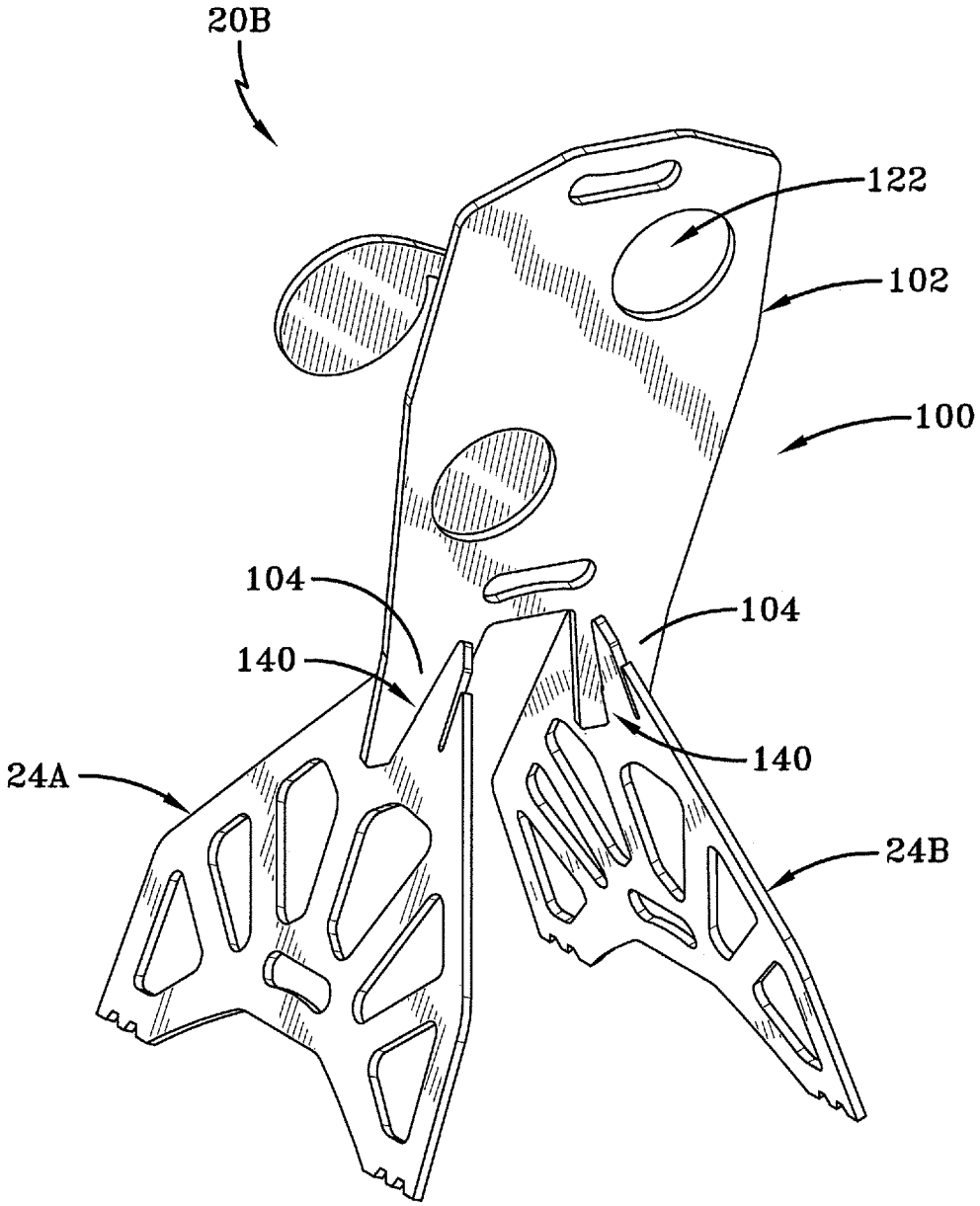

In the embodiment shown in FIG. 5A, the swinger 124 is mounted on the back surface of the swinger plate. In other words, the swinger target assembly 120 is configured so that the opening 122 faces the trainee and the target disc 126 is mounted on the backside of the swinger plate 102 facing away from the trainee, but wherein the target disc 126 is visible through the opening 122. Accordingly, when the bullet impacts the target disc 126, the impact causes the target disc 126 to rotate within the hinge mechanism 134 so that the target disc extends out away from the swinger plate 102 as shown in FIG. 5B. The trainee may then attempt to hit the target disc 126 in its extended position and, if successful, the bullet impact causes the target disc 126 to again cover the target opening 122.

As in the previous target stand 20A, a cross lap joint 140, which is substantially the same as the cross lap joint shown in FIG. 1A, is formed between the legs 24A, 24B, and corresponding hips 104. Similar to the previous embodiment, the leg slots 106 are coupled to the legs 24A and 24B such that the respective slot ends 110 are positioned adjacent or in close contact with the slot ends 88. As in the stand 20A, this prevents the swinger target member 100 from twisting or falling when impacted by bullets that strike either the swinger plate or the swinger target assemblies.

Figure 9:
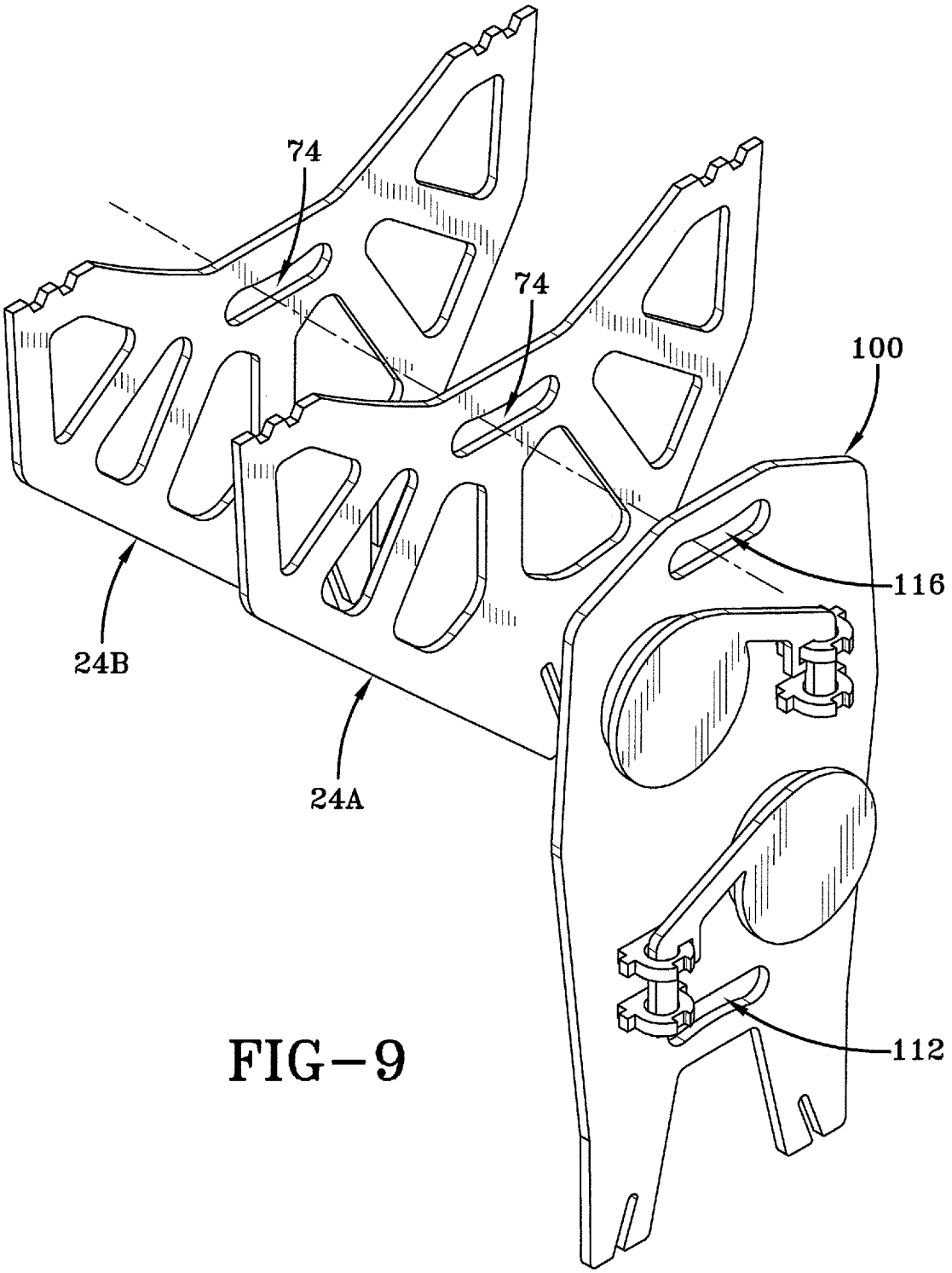
FIG. 9 is a perspective view showing the legs and the swinger target member aligned with their respective handle openings according to the concepts of the present invention.
Figure 10A:
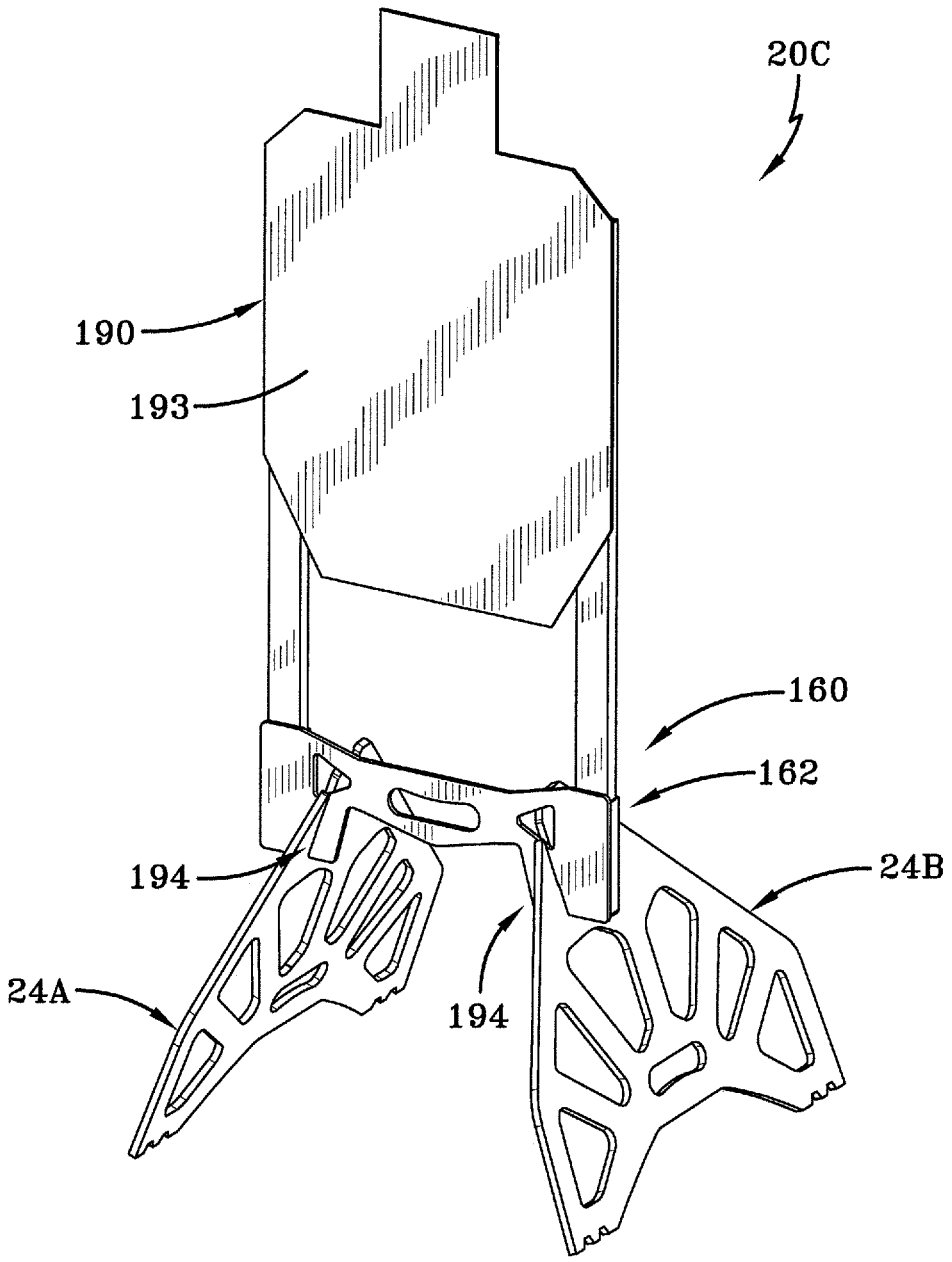
FIGS. 10A and 10B are front and rear perspective views, respectively, of a portable target stand utilizing a paper adapter member according to the concepts of the present invention.
Figure 10B:
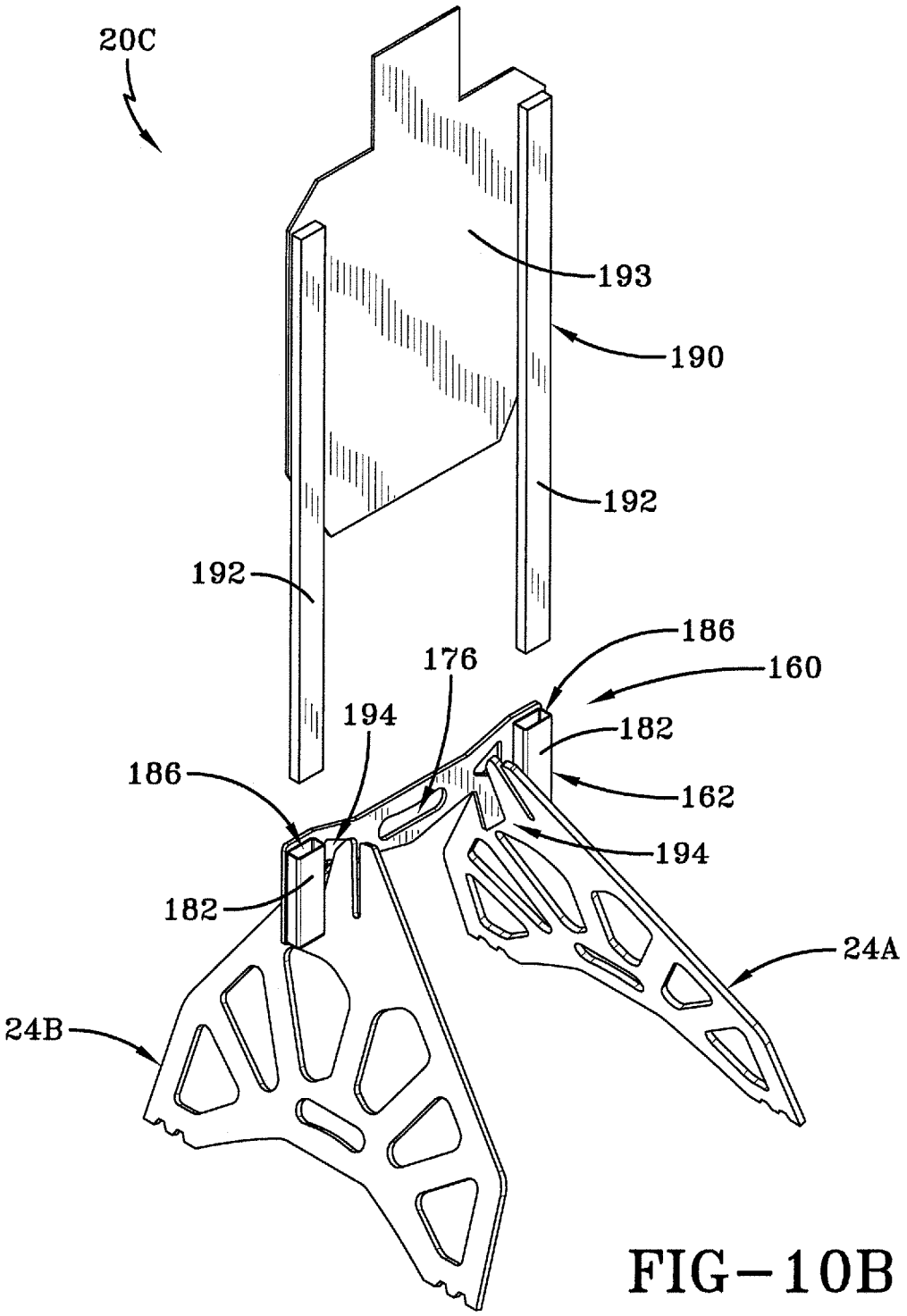
Figure 11:
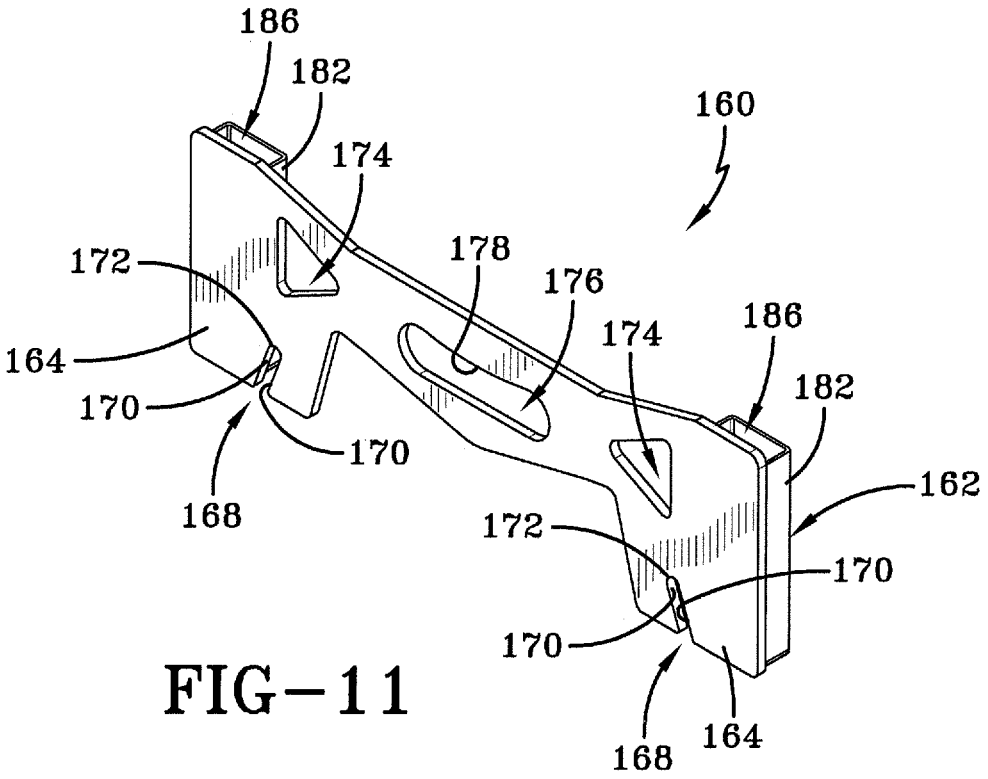
FIG. 11 is a front perspective view of the paper adapter member according to the concepts of the present invention.
Figure 12:
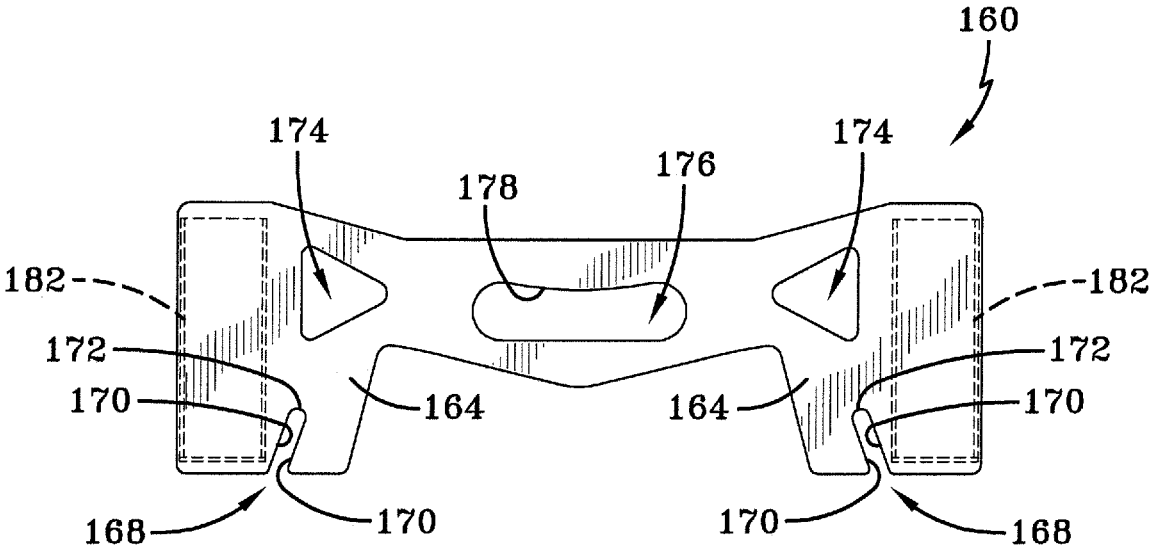
FIG. 12 is a front elevational view of the paper adapter member according to the concepts of the present invention.

As best seen in FIG. 9, the handle openings may be aligned with one another, as in the previous embodiment, so as to allow for carrying of the legs and target member 100. In this particular embodiment, the target member also provides for a second handle opening 116 to allow for the target member to be carried in two different ways.

Referring now to FIGS. 10-13, it can be seen that a portable target stand 20C may be associated with the legs 24A and 24B. The portable target stand 20C provides for a paper adapter member 160 which is supported by the legs 24A and 24B. This embodiment is employed where a trainee wants to utilize a paper target instead of the steel plates provided in the previous two embodiments. The paper adapter member 160 includes an adapter plate 162 which provides for downwardly extending hips 164. Each hip provides a leg slot 168 which is formed by a pair of substantially slot sides 170 which are connected to one another by a slot end 172. The slots 170 may be angled in a manner similar to the slots provided by the torso plate 80 and/or the swinger plate 102.

The adapter plate 162 may provide for body openings 174 so as to reduce the weight of the paper adapter member 160 while still providing the needed strength and durability for the member. Extending through the adapter plate 162 may be a handle opening 176 which provides for a curved carrying edge 178. As in the previous embodiments, this handle opening 176 is sized to be alignable with the other handle openings provided by the legs 24A and 24B.

The adapter plate may include end beams 182 at each opposed end of the adapter plate 162. Each beam 182 may provide for a post hole 186 which may receive a paper target 190 which comprises a pair of opposed posts 192 connected to one another by a board 193. Accordingly, when the adapter plate 162 is assembled to the legs 24A, 24B, the paper target 190 and the posts 192 may be received in the corresponding post holes 186.

As in the previous embodiments, a cross lap joint 194 similar to the other cross lap joints disclosed herein may be formed between the intersection of the legs with the corresponding hips 164. In this particular embodiment, the leg slots 168 are received in the adapter receiver slots 66 such that the slot ends 70 and 172 are positioned adjacent or in contact with one another. In this particular embodiment, it will be appreciated that the paper adapter member 160 is positioned in the adapter receiver slots which are oriented at substantially a ninety degree angle. As such, the paper adapter member 160 is oriented substantially vertically with respect to the ground and the supporting legs. In other words, the paper adapter member is not provided with a downwardly extending angle and, as such, any bullets that impact the paper adapter member 160 will not be directed downwardly to the ground upon impact.

Figure 13:
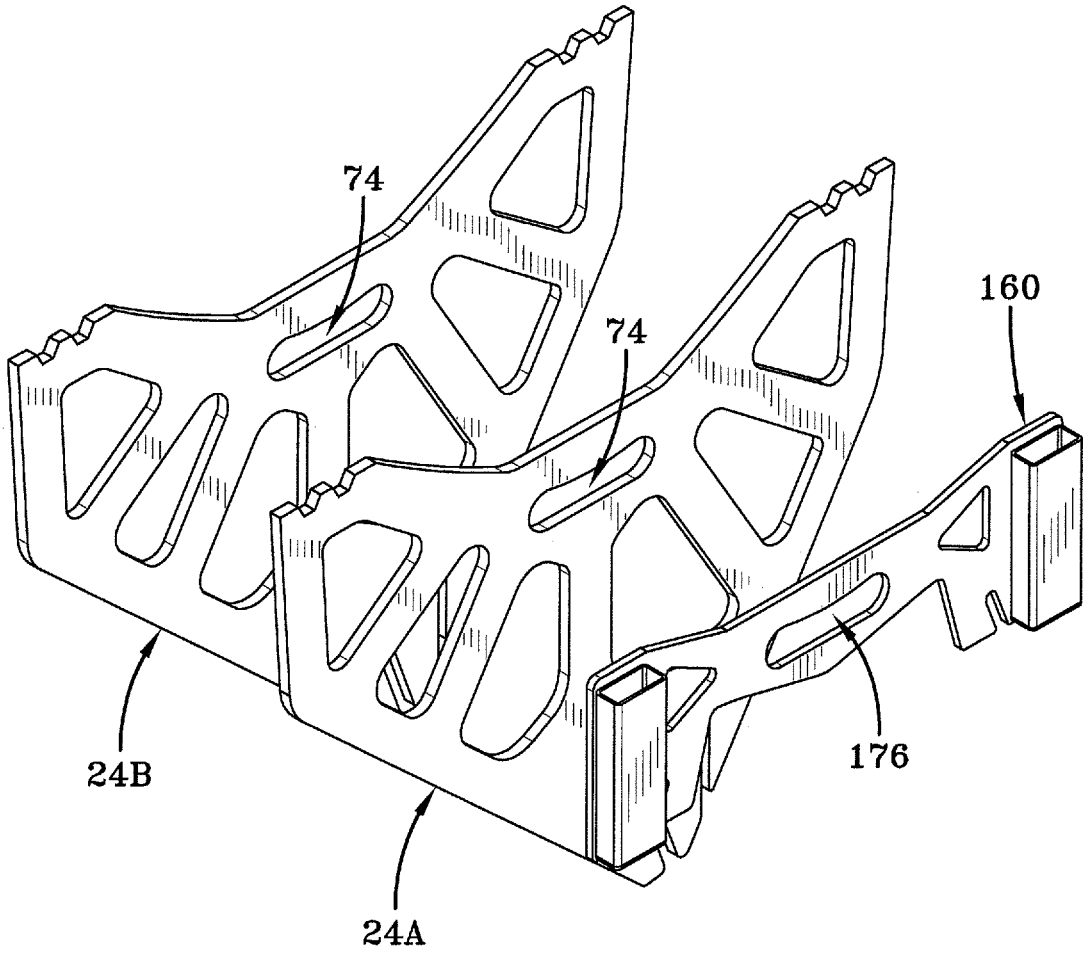
FIG. 13 is a perspective view of the legs and the paper adapter member aligned with their respective handle openings according to the concepts of the present invention.
Figure 14:
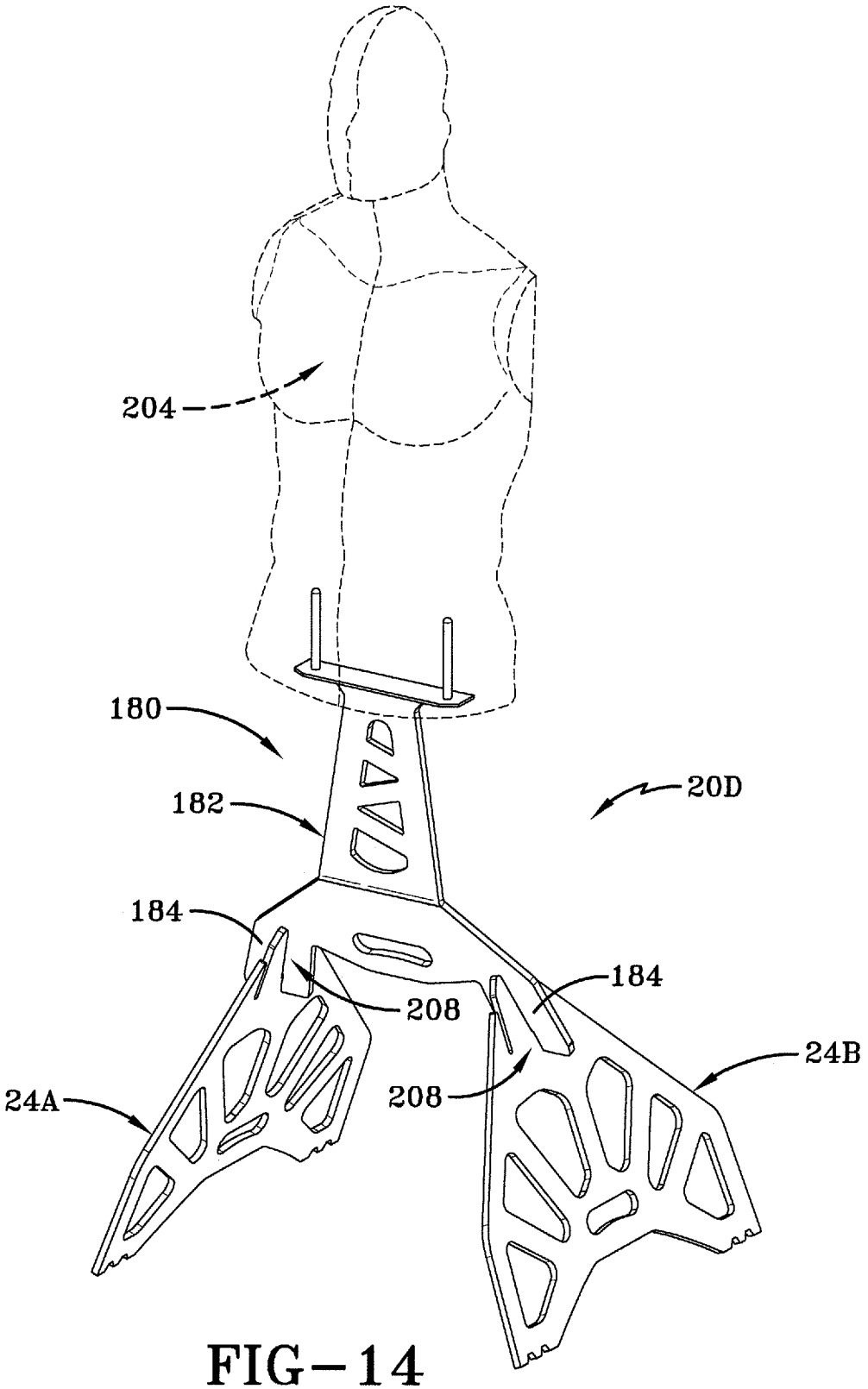
FIG. 14 is a perspective view of a portable target stand utilizing a dummy adapter member according to the concepts of the present invention.
Figure 15:
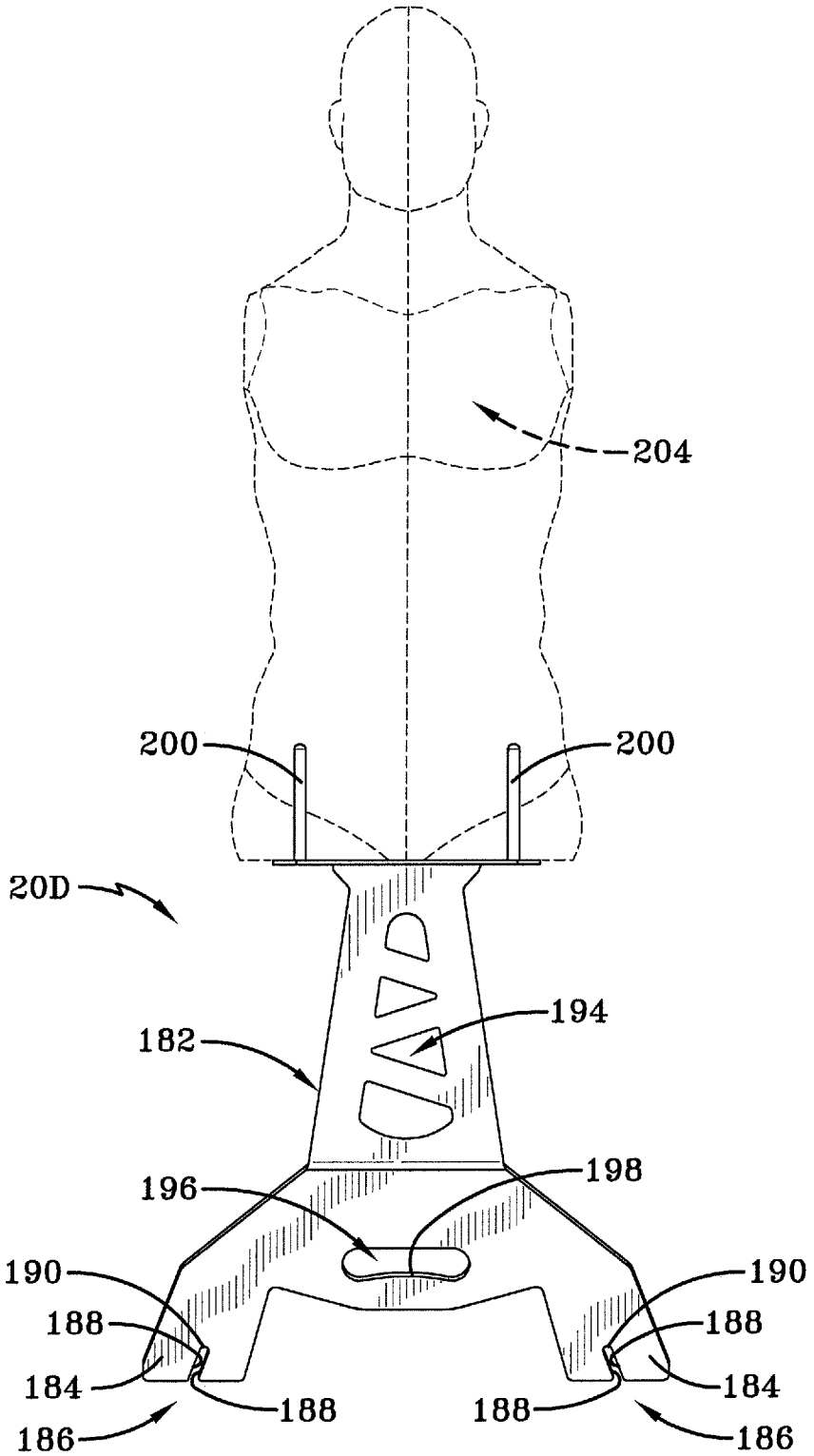
FIG. 15 is a front elevational view of the dummy adapter member according to the concepts of the present invention.

Referring to FIG. 13, it can be seen that the legs 24A and 24B may be aligned with the adapter plate 162. Specifically, the handle openings 74 may be aligned with the handle opening 176 to facilitate transport of the disassembled pieces of the target stand 20C.

Figure 16:
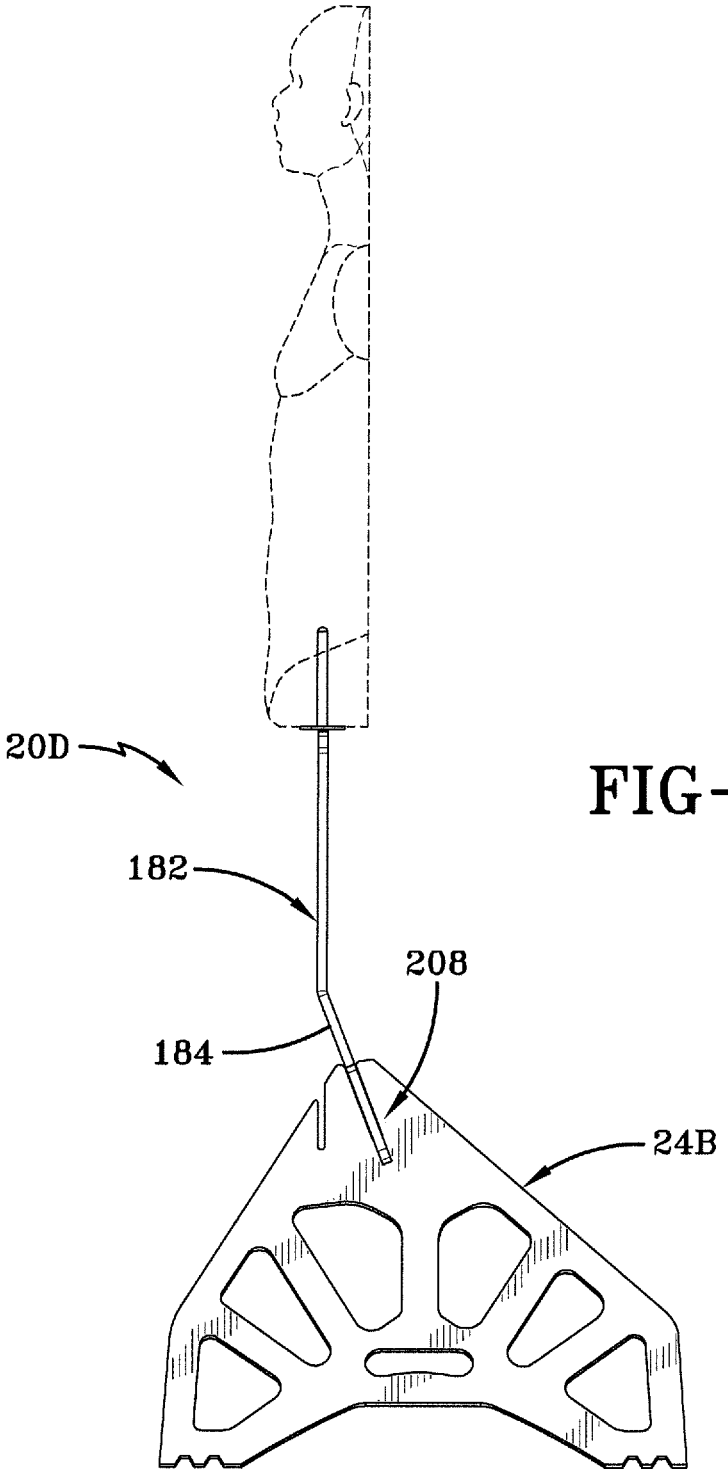
FIG. 16 is a side elevational view of the portable target stand utilizing the dummy adapter member according to the concepts of the present invention.
Figure 17:
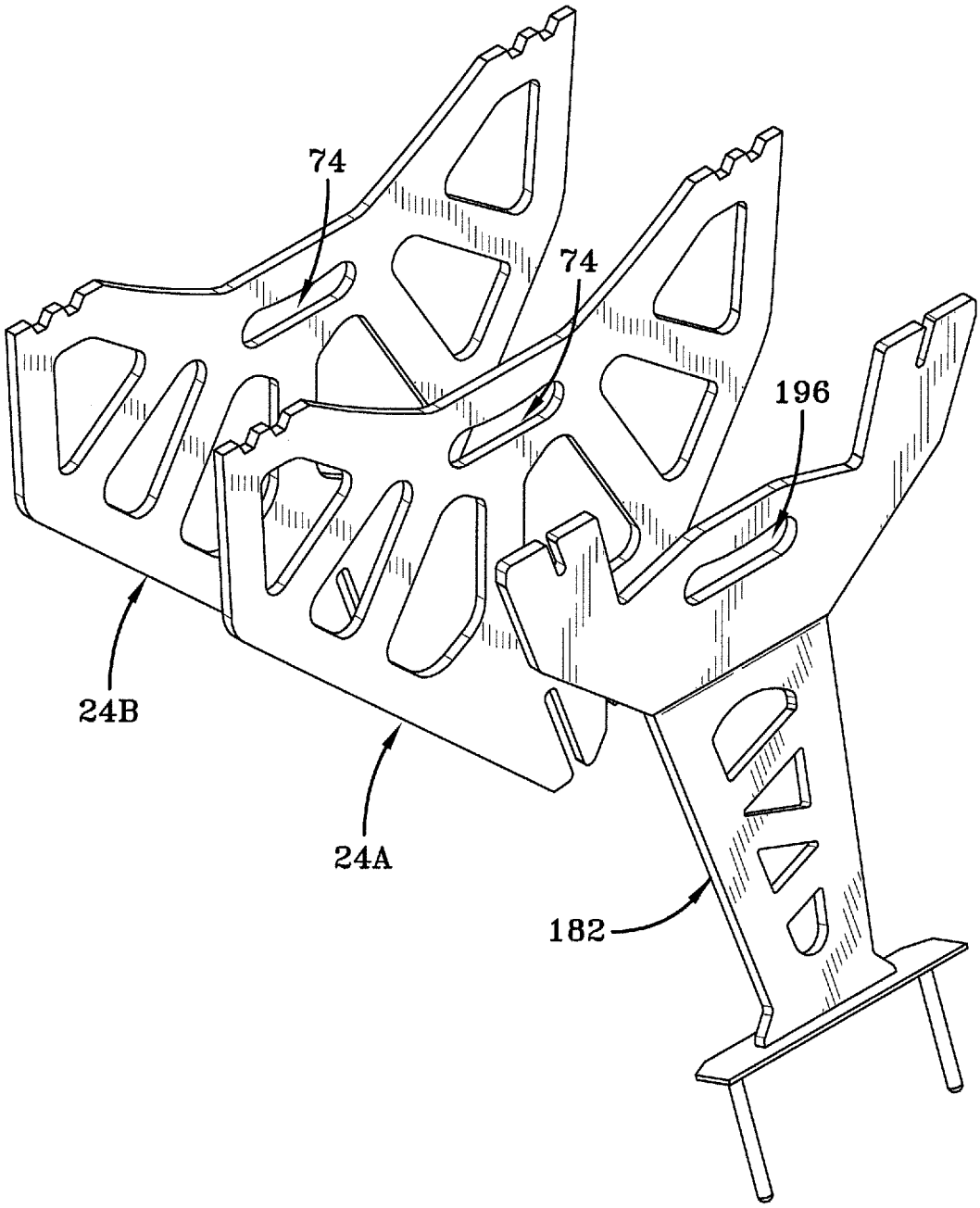
FIG. 17 is a perspective view of the legs and the dummy adapter member with their respective handle openings aligned with one another according to the concepts of the present invention.

Referring now to FIGS. 14-17, an alternative portable target stand 20D is shown. As in the previous embodiments, the target stand 20D employs the legs 24A and 24B, but in this particular embodiment the legs are configured to receive a dummy adapter member 180. The dummy adapter member 180 provides an adapter plate 182 which has a pair of downwardly extending angularly oriented hips 184. Each of the hips provide for a leg slot 186 which is formed by a pair of substantially parallel slot sides 188 which are connected to one another by a slot end 190. Each hip 184 may also be angled rearwardly with respect to the adapter plate 182. As a result, the adapter plate 182 is oriented vertically with respect to the ground as seen in FIG. 16.

The adapter plate 182 may provide for a plurality of body openings 194 therethrough so as to reduce the overall weight of the adapter plate. The adapter plate 182 may also provide for a handle opening 196 which provides for a curved carrying edge 198 that is substantially parallel with a bottom edge of the adapter plate between the hips 184. At an end opposite the hips 184 may be at least one spike 200 which extends from a top edge of the adapter plate 182. The spikes are configured so as to receive a ballistic gel torso 204 which may be used as the target for a trainee.

When the adapter plate 182 is assembled to the legs 24A and 24B, corresponding cross lap joints 208, similar to the other cross lap joints disclosed herein, are formed so as to provide a connection between the two. In particular, the adapter plate 182 is received in the adapter receiver slots 60 so that the ballistic gel torso and the adapter plate 182 are held in a substantially upright position in a manner similar to the plate 80 and the plate 102. Accordingly, the leg slots 186 are associated with the corresponding receiver slots 60 so as to form the portable target stand 20D. As in the previous embodiments, the dummy adapter member is easily assembled and not susceptible to twisting upon impact by bullets into the adapter plate 182 and/or the ballistic gel torso 204. Additionally, the dummy adapter member 180 is easily assembled and disassembled with the legs 24A and 24B.

Based upon the foregoing, the advantages of the present invention are readily apparent. First, the legs and associated members are easily assembled and disassembled to one another for use in a outdoor environment. By utilizing steel or other metal materials, the targets are of a substantial character and are not easily disassembled by bullet impacts or wind, or the like. Additionally, the legs and members 26, 100, 160, and 180 provide for corresponding handle openings which are alignable with one another such that the various plates are easily carried by a single person. As such, skilled artisans will appreciate that the target stands shown and disclosed herein are a significant improvement in the art.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A portable target stand system for deflecting bullets comprising:

a pair of legs separate from each other, each said leg having a flat body with a front edge, each said front edge having a receiver slot, and each said flat body having a bottom edge, wherein said receiver slots are positionally alignable with each other and wherein each said leg has a pair of feet extending from said bottom edge and said flat body has a leg handle opening with a carrying edge relatively parallel with said bottom edge and centered between said pair of feet;

a bullet-deflecting member having a flat torso plate, said flat torso plate having a pair of leg slots, each said leg slot slidably receiving one of said flat bodies, and each said receiver slot slidably receiving said member, wherein said flat torso plate has a lower edge, wherein said flat torso plate has a pair of downwardly extending hips from said lower edge, wherein each said hip projects at said lower edge at each side of a pelvic area of said flat torso plate, each said hip having a corresponding one of said leg slots, and wherein said flat torso plate has a torso handle opening centered between said pair of hips above said lower edge;

a cross lap joint formed between each said leg slot and a corresponding one of said receiver slots provided by each said leg, wherein said flat torso plate extends from said pair of hips to present a target above said cross lap joint, and wherein said leg and torso handle openings of said pair of legs and said flat torso plate, when disassembled, are alignable with each other to provide a balanced carrying point when said flat bodies and said flat torso plate are positioned side-by-side to facilitate their transport.

2. The system according to claim 1, wherein said bottom edge has an arc separating the pair of feet.

3. The system according to claim 1, wherein each said leg slot is oriented at an equivalent non-perpendicular angle with respect to said flat torso plate; and wherein each said receiver slot is oriented at an equivalent non-perpendicular angle with respect to said bottom edge so that when said pair of legs are assembled to said bullet-deflecting member, said flat torso plate presents a forward leaning stance such that impacting bullets are directed downwardly.

4. The system according to claim 1, wherein said bullet-deflecting member is selected from a group consisting of a torso target member and a swinger target member.

5. The system according to claim 1, further comprising:

at least one swinger assembly hingedly mounted to said flat torso plate which has a corresponding target opening therethrough.

6. The system according to claim 5, wherein said at least one swinger assembly comprises:

a hinge mechanism comprising a pair of collars extending from one side of said flat torso plate, each said collar having a collar hole therethrough aligned with each other; and a swinger having a swing arm with a target disc at one end and a hinge end at an opposite end, wherein said hinge end is rotatably received in said collar holes provided by said pair of collars, and wherein said target disc covers said target opening in a first position and extends away from said flat plate in a second position.

7. The system according to claim 1, wherein each said leg and said member is made of steel.

8. The system according to claim 1, wherein each said flat body has said front edge, which is tapered, and a back taper edge, wherein said front taper edge and said back taper edge connect at an apex, and wherein each said front taper edge has said corresponding receiver slot.

9. The system according to claim 8, wherein each said receiver slot is oriented at an equivalent non-perpendicular angle with respect to said bottom edge.

10. The system according to claim 8, wherein each said pair of feet comprise a front foot and a rear foot, wherein said front foot extends from said front edge and said rear foot extends from said back edge which extends from said back taper edge, and wherein said apex is closer to said front foot than said rear foot.

11. A portable and reusable firearms target stand system for deflecting bullets that is easily assembled and disassembled comprising:

a pair of legs separate from each other, each said leg having a flat body with a front edge, each said front edge having a receiver slot, wherein said receiver slots are positionally alignable with each other and wherein said flat body has a bottom edge and each said receiver slot is oriented at an equivalent non-perpendicular angle with respect to said bottom edge;

a bullet-deflecting member having a flat plate, said flat plate having a pair of leg slots, each said leg slot slidably receiving one of said flat bodies, and each said receiver slot slidably receiving said member, wherein said flat plate has a lower edge, wherein said flat plate has a pair of downwardly extending hips from said lower edge, wherein each said hip projects at said lower edge and each said hip has a corresponding one of said leg slots, and wherein each said leg slot is oriented at an equivalent non-perpendicular angle with respect to said flat plate; and a cross lap joint formed between each said leg slot and a corresponding one of said receiver slots provided by each said leg so that when said pair of legs are assembled to said member said lower edge is above said cross lap joint and said bullet-deflecting member presents a forward leaning stance such that impacting bullets are directed downwardly.

12. The system according to claim 11, wherein each said leg has a pair of feet and said flat body has a handle opening centered between said pair of feet, wherein said flat plate has a handle opening centered between said pair of hips, and wherein said handle openings of said pair of legs and said bullet-deflecting member, when disassembled, are alignable with each other to provide a balanced carrying point when said bodies and said flat plate are positioned side-by-side to facilitate their transport.

13. The system according to claim 11, wherein both said receiver slots have an angle between thirty degrees to eighty degrees with respect to a line which is substantially parallel with a line tangent to said pair of feet.

14. The system according to claim 11, wherein each said leg and said member has a thickness ranging from ⅛ inch to 1¼ inch.

15. The system according to claim 11, wherein each said flat body has said front edge, which is tapered, and a back taper edge, wherein said front taper edge and said back taper edge connect at an apex, and wherein each said front taper edge has said corresponding receiver slot.

16. The system according to claim 15, wherein each said pair of feet comprise a front foot and a rear foot, wherein said front foot extends from said front edge and said rear foot extends from said back edge which extends from said back taper edge, and wherein said apex is closer to said front foot than said rear foot.

* * * * *